US006750189B1

(12) United States Patent
Zhang et al.

(10) Patent No.: US 6,750,189 B1
(45) Date of Patent: Jun. 15, 2004

(54) FABRIC ENHANCEMENT COMPOSITIONS

(75) Inventors: Shulin Larry Zhang, West Chester, OH (US); Sherri Lynn Randall, Hamilton, OH (US); Rajan Keshav Panandiker, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/913,868

(22) PCT Filed: Feb. 16, 2000

(86) PCT No.: PCT/US00/03943

§ 371 (c)(1),
(2), (4) Date: Aug. 20, 2001

(87) PCT Pub. No.: WO00/49125

PCT Pub. Date: Aug. 24, 2000

Related U.S. Application Data

(60) Provisional application No. 60/120,992, filed on Feb. 19, 1999, and provisional application No. 60/134,955, filed on May 19, 1999.

(51) Int. Cl.[7] ..... C11D 7/32; C11D 7/26

(52) U.S. Cl. ..... 510/329; 510/327; 510/328; 510/330; 510/499; 510/500; 510/501; 510/476; 510/315

(58) Field of Search ..... 510/327, 328, 510/499, 501, 500, 475, 476, 329, 330, 515

(56) References Cited

U.S. PATENT DOCUMENTS

| | | | | |
|---|---|---|---|---|
| 5,460,736 A | | 10/1995 | Trinh et al. | |
| 5,629,278 A | * | 5/1997 | Baeck et al. | 510/236 |
| 6,020,302 A | * | 2/2000 | Leurentop et al. | 510/475 |
| 6,034,204 A | | 3/2000 | Mohr et al. | |
| 6,111,057 A | | 8/2000 | Mohr et al. | |
| 6,407,053 B1 | | 6/2002 | Randall et al. | |
| 6,525,013 B1 | * | 2/2003 | Littig et al. | 510/322 |
| 6,531,438 B1 | * | 3/2003 | Littig et al. | 510/322 |

FOREIGN PATENT DOCUMENTS

| | | | |
|---|---|---|---|
| WO | WO 98/12296 | * | 3/1998 |
| WO | WO 9907813 A | | 2/1999 |
| WO | WO 0022077 A | | 4/2000 |

* cited by examiner

*Primary Examiner*—Gregory R. Del Cotto
(74) *Attorney, Agent, or Firm*—Laura R. Grunzinger; Kim W. Zerby; Steven W. Miller

(57) ABSTRACT

The fabric care compositions comprising A) from 0.1% to 10% by weight amino acid based polymers which are alkoxylated with an average of 0.1 to 30 alkyleneoxy units; B) from 1% to 80% by weight, of a fabric softening active; and C) the balance carriers and adjunct ingredients wherein said compositions provide colored fabric with protection against the deleterious effects of mechanical wear and exposure to laundry-leaching added ingredients inter alia bleaching materials or water-borne materials inter alia heavy metal ions.

16 Claims, No Drawings

FABRIC ENHANCEMENT COMPOSITIONS

This applications claims priority to PCT application PCT/US00/03943, filed Feb. 16, 2000, claims priority under 35 USC 119(e) to U.S. provisional application No. 60/120,992 filed Feb. 19, 1999, and U.S. provisional application No. 60/134,955, filed May 19, 1999.

FIELD OF THE INVENTION

The present application relates to fabric care compositions which comprise one or more lysine and/or ornithine based polymers which provide enhanced fabric appearance benefits. The high molecular weight polyamino acids of the present invention which mitigate fabric damage and improve fabric appearance can be combined with other fabric softener actives to provide more complete mitigation of fabric damage.

BACKGROUND OF THE INVENTION

The domestic treatment of fabric is a problem known in the art to the formulator of laundry compositions. Hence, It is well known that alternating cycles of using and laundering fabrics and textiles, such as articles of worn clothing and apparel, will inevitably adversely affect the appearance and integrity of the fabric and textile items so used and laundered. Fabrics and textiles simply wear out over time and with use. Laundering of fabrics and textiles is necessary to remove soils and stains which accumulate therein and thereon during ordinary use. However, the laundering operation itself, over many cycles, can accentuate and contribute to the deterioration of the integrity and the appearance of such fabrics and textiles.

Deterioration of fabric integrity and appearance can manifest itself in several ways. Short fibers are dislodged from woven and knit fabric/textile structures by the mechanical action of laundering. These dislodged fibers may form lint, fuzz or "pills" which are visible on the surface of fabrics and diminish the appearance of newness of the fabric. Such a problem of fabric abrasion is even more acute after multi-wash cycles.

There exists a long felt need for compositions which provide fabric with protection against damage done due to fabric abrasion. In addition, there is a long felt need to provide compositions which provide a remedy for fabric abrasion damage.

SUMMARY OF THE INVENTION

The present invention meets the aforementioned needs in that it has been surprisingly discovered that polymers comprising lysine and/or ornithine and other compatible amino acid and carboxylic acid residues are suitable for use in rinse-added fabric care compositions to provide provide fabric appearance benefits inter alia mitigation of fabric damage, prevention of fabric mechanical damage.

A first aspect of the present invention relates to rinse-added fabric enhancement or fabric care compositions comprising:

A) from about 0.1%, preferably from about 1%, more preferably from 2.5% to about 30%, preferably to about 20%, more preferably to about 10% by weight, of a polymeric material selected from the group consisting of:
   a) homo-condensates of basic amino acids, said amino acids selected from the group consisting of lysine, ornithine, arginine, and tryptophan;

b) co-condensates of basic amino acids, said amino acids selected from the group consisting of lysine, ornithine, arginine, and tryptophan;
   c) co-polymers produced from the reaction of one or more basic amino acids with one or more co-condensable compounds;
   d) co-polymers produced from the reaction of one or more homo-condensates from (a) or co-condensates from (b) with one or more co-condensable compounds;
   e) crosslinked basic amino acid-containing polymers, said crosslinked polymers comprising:
      i) one or more basic amino acids;
      ii) co-polymers of (i) and one or more co-condensable compounds;
      iii) optionally co-polymers produced from the reaction of one or more homo-condensates from (a) or co-condensates from (b) with one or more co-condensable compounds; and
      iv) one or more crosslinking unit;
      wherein at least one crosslinking unit is derived from a crosslinker which comprises at least two functional groups;
   f) co-condensates formed from the reaction of one or more compounds selected from the group consisting of:
      i) basic amino acids;
      ii) co-condensable compounds;
      iii) crosslinking agents; and
   g) mixtures thereof;

B) from about 1% to about 80% by weight, of a fabric softening active; and

C) the balance carriers and adjunct ingredients.

A second aspect of the present invention relates to fabric care compositions comprising:

A) from about 0.1%, preferably from about 1%, more preferably from 2.5% to about 30%, preferably to about 20%, more preferably to about 10% by weight, of a polymeric material selected from the group consisting of:
   a) homo-condensates of basic amino acid, said amino acids selected from the group consisting of lysine, ornithine, arginine, and tryptophan;
   b) co-condensates of basic amino acids, said amino acids selected from the group consisting of lysine, ornithine, arginine, and tryptophan;
   c) co-polymers produced from the reaction of one or more basic amino acids with one or more co-condensable compounds.
   d) co-polymers produced from the reaction of one or more homo-condensates from (a) or co-condensates from (b) with one or more co-condensable compounds;
   e) crosslinked basic amino acid-containing polymers, said crosslinked polymers comprising:
      i) one or more basic amino acids;
      ii) co-polymers of (i) and one or more co-condensable compounds;
      iii) optionally co-polymers produced from the reaction of one or more homo-condensates from (a) or co-condensates from (b) with one or more co-condensable compounds; and
      iv) one or more crosslinking unit;
      wherein at least one crosslinking unit is derived from a crosslinker which comprises at least two functional groups;
   f) co-condensates formed from the reaction of one or more compounds selected from the group consisting of:

i) basic amino acids;
ii) co-condensable compounds;
iii) crosslinking agents:

g) optionally said homo-condensates from (a), co-condensates from (b), co-polymers from (c) and (d), crosslinked polymers from (e), and co-condensates from (f), are alkoxylated with from an average of 0.1 to about 30 alkyleneoxy units; and h) mixtures thereof;

B) optionally from about 0.01% by weight, of a fabric anti-abrasion polymer comprising:

i) at least one monomeric unit comprising an amide moiety;
ii) at least one monomeric unit comprising an N-oxide moiety;
iii) and mixtures thereof;

C) optionally from about 1%, preferably from about 10%, more preferably from about 20% to about 80%, preferably to about 60%, more preferably to about 45% by weight, of a fabric softening active;

D) optionally less than about 15% by weight, of a principal solvent, preferably said principal solvent has a ClogP of from about 0.15 to about 1;

E) optionally from about 0.001% to about 90% by weight, of one or more dye fixing agents;

F) optionally from about 0.01% to about 50% by weight, of one or more cellulose reactive dye fixing agents;

G) optionally from about 0.01% to about 15% by weight, of a chlorine scavenger;

H) optionally about 0.005% to about 1% by weight, of one or more crystal growth inhibitors;

I) optionally from about 1% to about 12% by weight, of one or more liquid carriers;

J) optionally from about 0.001% to about 1% by weight, of an enzyme;

K) optionally from about 0.01% to about 8% by weight, of a polyolefin emulsion or suspension;

L) optionally from about 0.01% to about 0.2% by weight, of a stabilizer;

M) from about 0.01% by weight, of one or more linear or cyclic polyamines which provide bleach protection; and N) the balance carrier and adjunct ingredients.

Another aspect of the present invention relates to rinse-added fabric enhancement or fabric care compositions comprising:

A) from about 0.1%, preferably from about 1%, more preferably from 2.5% to about 30%, preferably to about 20%, more preferably to about 10% by weight, of a polymeric material selected from the group consisting of:

a) homo-condensates of basic amino acid, said amino acids selected from the group consisting of lysine, ornithine, arginine, and tryptophan;
b) co-condensates of basic amino acids, said amino acids selected from the group consisting of lysine, ornithine, arginine, and tryptophan;
c) co-polymers produced from the reaction of one or more basic amino acids with one or more co-condensable compounds;
d) co-polymers produced from the reaction of one or more homo-condensates from (a) or co-condensates from (b) with one or more co-condensable compounds;
e) crosslinked basic amino acid-containing polymers, said crosslinked polymers comprising:

i) one or more basic amino acids;
ii) co-polymers of (i) and one or more co-condensable compounds:
iii) optionally co-polymers produced from the reaction of one or more homo-condensates from (a) or co-condensates from (b) with one or more co-condensable compounds; and
iv) one or more crosslinking unit;

wherein at least one crosslinking unit is derived from a crosslinker which comprises at least two functional groups;

f) co-condensates formed from the reaction of one or more compounds selected from the group consisting of:

i) basic amino acids;
ii) co-condensable compounds;
iii) crosslinking agents;

g) optionally said homo-condensates from (a), co-condensates from (b), co-polymers from (c) and (d), crosslinked polymers from (e), and co-condensates from (f), are alkoxylated with from an average of 0.1 to about 30 alkyleneoxy units; and h) mixtures thereof;

wherein said polymers from (a), (b), (c), (d), (e), (f), or (g) have one or more backbone hydrogen atoms substituted with an alkyleneoxy unit having the formula $—(RO)_xH$ wherein R is $C_2$–$C_{30}$ alkylene and x has an average value of from 0.1 to about 100;

B) from about 1% to about 80% by weight, of a fabric softening active; and

C) the balance carriers and adjunct ingredients.

A further aspect of the present invention provides a method for enhancing the color fidelity of fabric while reducing the damage to fabric due to the interaction of laundry adjunct ingredients and damage due to mechanical wear. This method comprise the step of contacting an article of fabric with the compositions of the present invention in an aqueous solution.

The present invention further provides laundry pre-soak compositions which are used to pre-treat fabric which have not been previously treated with a composition of the present invention. The disclosed pre-treatment compositions provide fabric and fabric color protection through the wash to the treated articles.

These and other objects, features and advantages will become apparent to those of ordinary skill in the art from a reading of the following detailed description and the appended claims. All percentages, ratios and proportions herein are by weight, unless otherwise specified. All temperatures are in degrees Celsius (° C.) unless otherwise specified. All documents cited are in relevant part, incorporated herein by reference.

DETAILED DESCRIPTION OF THE INVENTION

The present invention relates to fabric enhancement compositions which comprise from about 0.1%, preferably from about 1%, more preferably from 2.5% to about 30%, preferably to about 20%, more preferably to about 10% by weight, of one or more polymeric materials comprising lysine, ornithine, arginine, tryptophan, and mixtures thereof.

The basic amino acid-containing polymers of the present invention are selected from the group consisting of:

a) homo-condensates of basic amino acid, said amino acids selected from the group consisting of lysine, ornithine, arginine, and tryptophan;

b) co-condensates of basic amino acids, said amino acids selected from the group consisting of lysine, ornithine, arginine, and tryptophan;

c) co-condensate co-polymers produced from the reaction of one or more homo-condensates from (a) or co-condensates from (b) with one or more co-condensable compounds;

d) crosslinked basic amino acid-containing polymers, said crosslinked polymers comprising:
   i) homo-condensates;
   ii) optionally co-condensates;
   iii) optionally co-polymers produced from the reaction of one or more basic amino acids with one or more co-condensable compounds;
   iv) optionally co-polymers produced from the reaction of one or more homo-condensates from (i) or co-condensates from (ii) with one or more co-condensable compounds;
   said compound or mixtures thereof further reacted with:
   v) at least one crosslinker which comprises at least two functional groups as defined herein below;

e) co-condensates formed from the reaction of one or more compounds selected from the group consisting of:
   i) basic amino acids;
   ii) co-condensable compounds;
   iii) crosslinking agents:

f) mixtures thereof; and g) polymers (a), (b), (c), (d) or (e) which have one or more backbone hydrogen atoms substituted with an alkyleneoxy unit having the formula —$(RO)_xH$ wherein R is $C_2$–$C_{30}$ alkylene and x has an average value of from 0.1 to about 100, said alkyleneoxy unit substitution taking place during any step of the process for producing said alkyleneoxy substituted polymers.

For the purposes of the present invention the term "condensates" is used to refer to the polymers of groups (i), (ii), and (iii) separately or collectively. The following is a description of the polyamines suitable for use in the fabric enhancement compositions of the present invention.

Homo-condensates (a)

One aspect of the present invention relates to fabric enhancement compositions which comprise homo-condensates of "basic amino acids", said basic amino acids are selected from the group consisting of lysine, ornithine, arginine, tryptophan, and mixtures thereof. Homo-condensates, which are polyamines of type (a), for the purposes of the present invention comprise one amino acid, for example, all lysine amino acids. Typically the homo-condensates are linked via the ω-amino unit, however, linkage via the α-amino unit is also an embodiment of the present invention as well as homo-condensates which are mixtures of both α and ω linkages.

Co-condensates (b)

Another aspect of the present invention relates to co-condensates which are a mixture of two or more basic amino acids, for example, a mixture of lysine and ornithine amino acids. Typically the homo-condensates are linked via the ω-amino unit, however, linkage via the α-amino unit is also an embodiment of the present invention as well as co-condensates which arc mixtures of both α and ω linkages. Typically the co-condensates are linked via the ω-amino unit, however, linkage via the α-amino unit is also an embodiment of the present invention as well as homo-condensates which are mixtures of both α and ω linkages.

In order to produce homo-condensates or co-condensates, basic amino acids are preferably condensed thermally. Other methods for the production of basic amino acid-containing polymers are based on chemical methods (e.g. via N-carboxy anhydrides of the basic amino acids) or on microorganisms. The basic amino acids, as defined herein above, are lysine, arginine, ornithine, tryptophan, and mixtures thereof. These compounds may be used in the form of their hydrates, ester of lower alcohols, or salts, for instance their sulfates, hydrochlorides or acetates. The esters of the basic amino acids are preferably derived from monovalent $C_1$–$C_4$ alcohols inter alia methanol, ethanol. When hydrochlorides are use, approximately equivalent quantities of a base should be added to the reaction mixture for neutralization of hydrogen chloride. Sodium hydroxide and potassium hydroxide are the preferred bases. If a monohydrochloride of a basic amino acid is used, one equivalent of a base is necessary whereas in case of dihydrochorides two equivalents are required. Lysine hydrate and aqueous solutions of lysine are preferably used as basic amino acid. Lysine can also be used in form of its cyclic lactam, i.e., α-amine-ε-caprolactam.

For the purposes of the present invention the term "weight average molecular weight", $M_w$, is defined herein as "the average molecular weight of a polymer admixture". Those skilled in the art will recognize that a homo-condensate with a $M_w$ equal to 1000 daltons will comprise some amount of homo-condensates having a molecular weight less than 1000 daltons and some having a molecular weight greater than 1000 daltons.

The homo-condensates of the present invention have a $M_w$ of from about 300 daltons to about 1,000,000 (million) daltons, preferably to about 20,000 daltons, more preferably to about 2,000 daltons.

Basic Amino Acid/Co-Condensable Compound Co-polymers (c)

A further aspect of the present invention relates to fabric enhancement compositions which comprise co-polymers which are the reaction product of one or more basic amino acids and one or more "co-condensable compounds". In their basic form these compounds are co-polymers produced from the reaction of one or more basic amino acids with one or more of the co-condensable compounds described herein below. "Co-condensable compounds" are defined herein as "compounds which are capable of reacting with basic amino acids or other co-condensates to form polymeric materials having desirable properties". For the purposes of the present invention the term "basic amino acid/co-condensable compound co-polymers" are defined herein as "the reaction product of one or more a basic amino acids prior to polymerization and one or more of the co-condensable compounds further described herein".

For the purposes of the present invention the term "ethylenically unsaturated" is defined herein as "a compound, aliphatic or otherwise, which comprises one double bond, for example, an olefin moiety". A preferred example of a single "ethylenically unsaturated" compound suitable for use in forming the condensable compounds and crosslinked compounds of the present invention is acrylic acid and derivatives therefrom, inter alia, methyl acrylate, acrylamide.

Non-limiting examples of compounds which are co-condensable with basic amino acids include:

i) compounds having at least one carboxyl group;

ii) carboxylic acid anhydrides;

iii) diketenes;

iv) amines;

v) lactams;

vi) alcohols;

vii) alkoxylated alcohols; and viii) alkoxylated amines.

Carboxyl Group-containing Compounds (i)

Suitable carboxyl group-containing compounds include saturated mono basic carboxylic acids (alkyl carboxylic acids); unsaturated monobasic carboxylic acids (alkenyl carboxylic acids); poly basic carboxylic acids (di-carboxylic acids); mono hydroxycarboxylic acids; mono basic polyhydroxy carboxylic acids; non-proteinogenic amino acids, inter alia amino butyric acid, and mixtures thereof.

Non-limiting examples of saturated mono basic carboxylic acids (alkyl carboxylic acids) include $C_1$–$C_{30}$ linear alkyl carboxylic acids, inter alia, formic acid, acetic acid, propionic acid, butyric acid, valeric acid, caproic acid (hexanoic acid), caprylic acid (octanoic acid), nonanoic acid, capric acid (decanoic acid), undecanoic acid, lauric acid (dodecanoic acid), myristic acid (tetradecanoic acid), palmitic acid (hexadecanoic acid), stearic acid (octadecanoic acid), arachidic acid (eicosanoic acid), behenic acid (docosanoic acid), $C_3$–$C_{30}$ branched alkyl carboxylic acids, inter alia, 2-ethyl hexanoic acid, as well as all other naturally occuring fatty acids and mixtures thereof.

Non-limiting examples of unsaturated mono basic carboxylic acids include $C_3$–C30 alkenyl carboxylic acids, inter alia, acrylic acid, methacrylic acid, crotonic acid, sorbic acid, oleic acid, linolenic acid, and erucic acid.

Non-limiting examples of polybasic carboxylic acids include $C_2$–$C_{30}$ dicarboxylic acids, inter alia, oxalic acid, fumaric acid, maleic acid, malonic acid, succinic acid, itaconic acid, adipic acid, aconitic acid, suberic acid, azeleic acid, pyridinedicarboxylic acid, furandicarboxylic acid, phthalic acid, terephthalic acid, diglycolic acid, glutaric acid, substituted $C_4$-dicarboxylic acid, sulfosuccinic acid, $C_2$–$C_{26}$ alkylsuccinic acids, $C_2$–$C_21$ alkenylsuccinic acids, 1,2,3-propanetricarboxylic acids, 1,1,3,3-propanetetracarboxylic acids, 1,1,2,2-ethanetetracarboxylic acid, 1,2,3,4-butanetetracarboxylic acid, 1,2,2,3-propanetetracarboxylic acid, 1,3,3,5-pentanetetracarboxylic acid, 1,2,4-benzene-tricarboxylic acid, and 1,2,4,5-benzenetetracarboxylic acid.

Non-limiting examples of mono- and polyhydroxy saturated and unsaturated carboxylic acids include $C_3$–$C_{30}$ dicarboxylic acids, inter alia, malic acid, tartaric acid, citric acid, isocitric acid, tartaric acid, mucic acid, glyceric acid, bis (hydroxymethyl)propionic acid, gluconic acid, and dihydroxystearic acid.

Non-limiting examples of non-proteinogenic amino acids include anthranilic acid, N-methylamino substituted acids, inter alia, N-methylglycine and dimethylaminoacetic acid, ethanolaminoacetic acid, N-carboxymethylamino acids, nitrilotriacetic acid, ethylene-diamineacetic acid, ethylenediarinotetraacetic acid, diethylenetriaminepentaacetic acid, hydroxyethylenediaminotriacetic acid, diaminosuccinic acid, $C_4$–$C_{26}$ aminoalkyl-carboxylic acids, inter alia, 4-aminobutyric acid, 6-aminocaproic acid, and 11-aminoundecanoic acid.

Non-limiting examples of carboxyl group-containing compounds which are not "basic amino acids" or other a-amino acids but which are suitable for condensation with the basic amino acids of the present invention include mono-saccharide carboxylic acids, inter alia, gluconic acid, glutaric acid, gluconolactone, and glucuronic acid.

Carboxylic Acid Anhydrides (ii)

Carboxylic anhydrides are also suitable as co-condensable compounds non-limiting Examples of which include succinic anhydride, mono and di-anhydride of butanetetracarboxylic acid, phthalic anhydride, acetylcitric anhydride, maleic anhydride, itaconic anhydride, and aconitic anhydride.

Diketenes (iii)

Diketenes which are suitable co-condensable compounds according to the present invention include $C_1$–$C_{30}$ substituted diketenes having the formula:

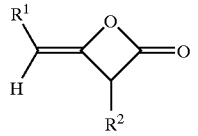

wherein $R^1$ and $R^2$ are each independently hydrogen, $C_1$–$C_{30}$ saturated or ethylenically unsaturated alkyl. Non-limiting examples of diketenes include diketene, methyl diketene, hexyl diketene, cyclohexyl diketene, octyl diketene, decyl diketene, dodecyl diketene, palmityl diketene, stearyl diketene, oleyl diketene, eicosyl diketene, docosyl diketene, and behenyl diketene.

Amines (iv)

Non-limiting examples of amines which are suitable co-condensable compounds according to the present invention include $C_1$–$C_{30}$ aliphatic and cycloaliphatic amines, preferably methylamine, ethylamine, propylamine, butylamine, pentylamine, hexylamine, heptylamine, octylamine, nonylamine, decylamine, undecylamine, dodecylamine, tridecylamine, stearylamine, palmitylamine, 2-ethylhexylamine, isononylamine, hexamethyleneamine, dimethylamine, dicthylamine, dipropylaminc, dibutylamine, dihexylamine, ditridecylamine, N-methylbutylamine, N-ethylbutylamine, alicyclic amines, preferably cyclopentylamine, cyclohexylamine, N-methylcyclohexylamine, N-ethylcyclohexylamine, dicyclohexylamine. Also suitable for use as co-condensable compounds according to the present invention are diamines, triamines, and tetraamines, non-limiting examples of preferred polyamines include ethylenediamine, propylenediamine, butylenediamine, neopentyldiamine, hexamethylenediamine, octamethylene-diamine, imidazole, 5-amino-1,3-trimethylcyclohexylmethylamine, diethylenetriamine, dipropylenetriamine, tripropyltetraamine, 4,4'-methylenebiscyclohexylaminc, 4,4'-methyneibis (2-methylcyclohexylamine), 4,7-dioxa-decyl-1,10-diamine, 4,9-dioxadodecyl-1,12-diamine, 4,7,10-trioxatridecyl-1,13-diamine, 2-(ethylamino)ethylamine, 3-(methylamino) propylamine, 3-(cyclohexylamino)ethylamine, 3-(2-aminoethyl)amino-propylamine, 2-(diethylamino) ethylamine, 3-(dimethylamino)propylamine, dimethyldipropylene-triamine, 4-aminomethyloctne-1,8-diamine, 3-(diethylamino)-propylamine, N,N-diethyl-1,4-pentanedimane, diethylcnetriamine, dipropylenetriamine, bis(hexamethylene)triamine, aminoethyl-piperazine, aminopropylpiperazine, NN-bis(aminopropyl)methylamine, N,N-bis(aminopropyl)-ethylamine, N,N-bis(aminopropyl)-hexylamine, N,N-bis(aminopropyl)octylamine, N,N-dimethyldi-propylenetriamine, N,N-bis(3-dimethylaminopropyl)amine, N,N'-1,2-ethanediylbis-(1,3-propane-diamine), N-(aminoethyl)piperazine, N-(2-inidazole)piperazine, N-ethylpiperazine, N-(hydroxyethyl)-piperazine, N-(aminopropyl)piperazine, N-(aminoethyl) morpholine, N-(aminopropyl)-morpholine, N-(aminoethyl) imidazole, N-(aminopropyl)imidazole, N-(aminoethyl) hexamethylenediamine, N-(aminopropyl) hexamethylenediamine, N-(aminoethyl)ethylene-diamine, N-(aminopropyl)ethylene-diamine, N-(aminoethyl)

butylenediamine, N-(aminopropyl)butylenediamine, bis(aminoethyl)piperazine, bis(aminopropyl)piperazine, bis(aminoethyl)hexamethylenediamine, bis(aminopropyl)hexamethylene-diamine, bis(aminoethyl)ethylenediamine, bis(aminopropyl)ethylenediamine, bis(aminoethyl)-butylenediamine, and bis(aminopropyl)butylenediamine.

Included within the category of "amines" which are suitable for use as co-condensates are amino alcohols, non-limiting examples of which include 2-aminoethanol, 3-amino-1-propanol, 1-amino-2-propanol, 2-(2-aminoethoxy)ethanol, 2-[2-aminoethyl)amino]ethanol, 2-methylaminoethanol, 2-(ethylamino)ethanol, 2-butylaminoethanol, ethanolamine, 3-[(hydroxyethyl)-amino]-1-propanol, diisopropanolamine, bis(hydroxyethyl)aminoethylamine, bis(hydroxypropyl)amino-ethylamine, bis(hydroxyethyl)amino-propylamine, and bis(hydroxypropyl)aminopropylamine.

Also included in the category of "amines" which are suitable for use as co-condensates are amino-saccharides, non-limiting examples of which include chitosan, chitosamine, and compounds which are obtained from reducing sugars (carbohydrates) by reductive amination, inter alia, aminosorbitol and glucoseamine.

Further included in the category of "amines" which are suitable for use as co-condensates are other amino-group containing compounds, inter alia, melamine, urea, guanidine, polyguanides, piperidine, morpholine, 2,6-dimetylmorpholin, tryptamine.

Lactams (v)

Non-limiting examples of lactams which are suitable co-condensable compounds according to the present invention are those which comprise from 5 to 13 carbon atoms in the lactam ring, non-limiting examples of which include butyrolactam, caprolactam, valerolactam, and laurolactam.

Alcohols (vi)

Non-limiting examples of $C_1$–$C_{22}$ primary, secondary, and tertiary alcohols which are suitable co-condensable compounds according to the present invention include methanol, ethanol, n-propanol, isopropanol, n-butanol, isobutanol, t-butanol, pentanol, hexanol, 2-ethylhexanol, cyclohexanol, octanol, decanol, dodecanol, palmityl alcohol, stearyl alcohol, and behenyl alcohol. Further suitable alcohols include polyols, for example, ethylene glycol, propylene glycol, glycerol, polyglycerols having for 2 to 8 glycerol units, erythritol, pentacrythritol, and sorbitol.

Other alcohols which are suitable co-condensable compounds according to the present invention include carbohydrates, inter alia, glucose, sucrose, dextrins, starch and degraded starch and maltose.

Alkoxylated Alcohols (vii)

Non-limiting examples of alkoxylated alcohols which are suitable co-condensable compounds according to the present invention are the addition products of from 1 to 200 moles of $C_2$–$C_4$ alkylene oxides with one mole of the hereinbefore described alcohols (vi). Suitable alkylene oxides include ethylene oxide, propylene oxide, and butylene oxide, preferably ethylene oxide and propylene oxide, more preferably ethylene oxide. A further preferred embodiment comprises mixtures of propylene oxide and ethylene oxide wherein said oxides are added in any order. Also suitable for use in the present application are addition products of from 3 to 30 moles of ethylene oxide with 1 mole of $C_{13}$–$C_{15}$ oxo process alcohols or with fatty alcohols. The alcohols may also be alcohols which comprise double bonds inter alia oleyl alcohol.

Alkoxylated Amines (viii)

Non-limiting examples of alkoxylated amines which are suitable co-condensable compounds according to the present invention are the addition products of from 5 to 30 moles of ethylene oxide with 1 mole of an aliphatic amine, inter alia, stearylamine, oleylamine or palmitylamine.

Homo-condensate/Co-condensate Condensable Compound Co-polymers (d)

A further aspect of the present invention relates to fabric enhancement compositions which comprise homo-condensates or co-condensates of basic amino acids and "co-condensable compounds". In their basic form these compounds are co-polymers produced from the reaction of one or more homo-condensates from (i) or co-condensates from (ii) w with one or more co-condensable compounds. "Condensable compounds" are defined herein as compounds which are capable of reacting with pre-formed homo-condensates or co-condensates to form polymeric materials having desirable properties. For the purposes of the present invention the term "homo-condensate/co-condensate condensable compound co-polymer" is defined herein as "the reaction product of a homo-condensate or co-condensate and one or more co-condensable compound as described herein".

Crosslinked Basic Amino Acid-containing Polymers (e)

A further aspect of the present invention relates to crosslinked basic amino acid-containing polymers wherein homo-condensates and/or co-condensates are further crosslinked with a suitable crosslinker described herein below. In general, the crosslinked polymers of the present invention comprise:

i) homo-condensates;

ii) optionally co-condensates;

iii) optionally co-polymers produced from the reaction of one or more basic amino acids with one or more co-condensable compounds;

iv) optionally co-polymers produced from the reaction of one or more homo-condensates from (i) or co-condensates from (ii) with one or more co-condensable compounds;

which are further reacted together to form a basic amino acid containing polymer, said polymer with:

v) at least one crosslinker which comprises at least two functional groups as defined herein below.

For the purposes of the present invention the term "functional group" is defined herein as "a moiety which serves to form a bond between the crosslinking unit and the basic amino acid-containing polymer units which are being crosslinked." Non-limiting examples of functional groups are halogen units, which are for example, displaced by the amino units of the polyamine backbone, during the process of forming the crosslinks. An example of a preferred functional group is the ethylene or olefin unit referred to throughout the present specification as an "ethylenically unsaturated" unit. This functional group serves during crosslinking reactions as a Michael addition acceptor thereby forming a bond between the amino unit of the condensates and the crosslinking unit.

The crosslinked polyamines of the present invention can be formed by the reaction of the selected polyamine with a suitable crosslinker non-limiting examples of which include the α-, ω-, or vicinal dichloroalkanes 1,2-dichloroethane, 1,2-dichlorpropane, 1,3-dichloropropane, 1,4-dichlorobutane, and 1,6-dichlorohexane. Another example of a suitable crosslinker, but wherein the two functional groups are different, are the glycidyl halides non-limiting examples of which include epichlorohydrin, bis-chlorohydrins ethers of polyols, polychlorohydrin ethers of polyols, bis-chlorohydrin ethers of polyalkylene glycols, chloroformic acid esters. Another suitable crosslinking agent is phosgene.

Examples of preferred crosslinking units according to the present invention include epichlorohydrin, bis-chlorohydrin ethers of ethylene glycol, polyethylene glycol having 2 to 100, preferably 2 to 40 ethylene glycol units, propylene glycols, polypropylene glycols, copolymers of ethylene oxide and propylene oxide, glycerol, diglycerol, polyglycerol having up to 8 glycerol units, pentaerythritol and sorbitol.

The preferred crosslinkers of the present invention are halogen-free crosslinkers. Non-limiting examples of preferred bifunctional crosslinkers of the present invention are selected from the group consisting of:

i) ethylene carbonate, propylene carbonate, urea, or mixtures thereof;

ii) monoethylenically unsaturated carboxylic acids and their esters, amides, and anhydrides; dibasic saturated carboxylic acids, polycarboxylic acids and the esters, amides, and anhydrides derived therefrom;

iii) reaction products of:

a) polyether diamines, alkylene diamines, polyalkylene polyamines, alkylene glycols or polyalkylene glycols, and mixtures thereof; and b) monoethylenically unsaturated carboxylic acids, esters, amides, or anhydrides wherein the reaction products comprise at least two units selected from the group consisting of ethylenically unsaturated double bonds, carboxamide, carboxyl, ester groups, and mixtures thereof;

iv) reaction products of dicarboxylic acid esters with ethyleneimine, wherein said products comprise at least two aziridino units;

v) di-epoxies, polyepoxides, α,ω-diisocyanates hexamethylene diisocyanate, inter alia, and polyisocyanates;

vi) and mixtures thereof.

Crosslinker Group (i)

The crosslinkers of group (i) comprise cyclic carbonates non-limiting examples of which include ethylene carbonate and propylene carbonate, as well as other carbonyl comprising crosslinking units, urea, inter alia. A preferred crosslinker from (i) is propylene carbonate.

Crosslinker Group (ii)

Non-limiting examples of suitable crosslinkers from (ii) include monoethylenically unsaturated monocarboxylic acids, inter alia, acrylic acid, methacrylic acid, crotonic acid, an in addition the amides, esters and anhydrides derived therefrom. The esters can be derived from alcohols having from 1 to 22, preferably up to 18 carbon atoms, While the amides are preferably unsubstituted, they can, however, comprise a $C_1$–$C_{22}$ alkyl radical as the nitrogen substituent.

Halogen free crosslinkers from (ii) also include dibasic saturated carboxylic acids, their salts, diesters, and diamides derived therefrom having the formula:

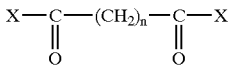

wherein X is —OH, —OR, —$N(R^1)_2$, and mixtures thereof; R is $C_1$–$C_{22}$ alkyl, and mixtures thereof; $R^1$ is hydrogen, $C_1$–$C_{22}$ alkyl, and mixtures thereof; the index n if from 0 to 22. In addition, monoethylenically unsaturated dicarboxylic acids, non-limiting examples of which include maleic acid and itaconic acid, are suitable for use in forming the group (ii) crosslinkers.

Dicarboxylic acids which are preferred as crosslinkers are derived from $C_1$–$C_4$ alcohols, inter alia, methyl esters, non-limiting example of which include dimethyl oxalate, diethyl oxalate, diisopropyl oxalate, dimethyl succinate, diethyl succinate, diisopropyl succinate, di-n-propyl succinate, di-isobutyl succinate, dimethyl adipate, diethyl adipate, and di-isopropyl adipate, dimethyl maleate, diethyl maleate, di-isopropyl maleate, dimethyl itaconate, di-isopropyl itaconate, dimethyl tartrate, and diethyl tartrate. In the case of carboxylic acids having more than one optical isomer; inter alia, tanaric acid, all optical forms and the racemic mixture are equally suitable.

Non-limiting examples of suitable dicarboxylic acid anhydrides include maleic anhydride, itaconic anhydride, and succinic anhydride. Aziridines are crosslinked with the herein above described halogen-free crosslinkers with the formation of amide groups or, in the case of amides such as adipic acid diamide, by means of transamidation. Maleic esters, and monoethylenically unsaturated dicarboxylic acids, and also their anhydrides, can effect crosslinking both by forming carboxamide groups and also by adding —NH groups by means of a Michael addition.

Also suitable for use as group (ii) crosslinkers are tricarboxylic and tetracarboxylic acids non-limiting examples of which include citric acid, propanetricarboxylic acid, ethylenediaminetetraacetic acid and butanetetracarboxylic acid, as well as, their salts, esters, amides, and anhydrides.

Polycarboxylic acids which can be obtained by polymerizing mono-ethylenically unsaturated carboxylic acids or anhydrides are also suitable group (ii) crosslinkers. Non-limiting examples of suitable mono-ethylenically unsaturated carboxylic acids include acrylic acid, methacrylic acid, crotonic acid, maleic acid, itaconic acid, and mixtures thereof. Thus, for example, polyacrylic acids, copolymers of acrylic acid and methacrylic acid or copolymers of acrylic acid and maleic acid are suitable for use as crosslinkers.

Further suitable crosslinkers from group (ii) are prepared, for example, by polymerizing anhydrides, such as maleic anhydride, in an inert solvent, such as toluene, xylene, ethylbenzene, isopropyl benzene, or mixtures thereof in the presence of free radical-forming initiators. Preference is given to using peroxy esters, such as tert-butyl per-2-ethylhexanoate, as initiators. Copolymers of maleic anhydride for example copolymers of acrylic acid and maleic anhydride or copolymers of maleic anhydride and a $C_2$–$C_{30}$ olefin, are also suitable in addition to the homopolymers.

Further preferred crosslinkers are copolymers of maleic anhydride and isobutene or copolymers of maleic anhydride and di-isobutene. The anhydride group-containing copolymers may, where appropriate, be modified by reacting them with $C_1$–$C_{20}$ alcohols or ammonia, amines, or mixtures thereof, and be employed in this form as crosslinkers.

The molar mass, $M_w$, of the homopolymers and copolymers which is subsequently crosslinked is preferably from about 500 daltons to about 10,000 daltons, preferably to about 5,000 daltons.

When the carboxylic acids of group (ii) are used as crosslinking agents, they may be used in the form of their alkali metal salts or ammonium salts, preferably the sodium salt. Optionally, the polycarboxylic acids can be partially neutralized, e.g., up to from 10 to 50 mol %, or else completely neutralized.

The preferred group (ii) crosslinkers are dimethyl tartrate, diethyl tartrate, dimethyl adipate, diethyl adipate, dimethyl maleate, diethyl maleate, maleic anhydride, maleic acid, acrylic acid, methyl acrylate, ethyl acrylate, acrylamide, methacrylamide, and mixtures thereof.

Crosslinker Group (iii)

Examples of halogen-free group (iii) crosslinkers are the reaction products of polyether diamines, alkylene diamines, polyalkylene polyamines, alkylene glycols, polyalkylene glycols, and mixtures thereof, together with:

a) monoethylenically unsaturated carboxylic acids;

b) esters of monoethylenically unsaturated carboxylic acids;

c) amides of monoethylenically unsaturated carboxylic acids;

d) anhydrides of monoethylenically unsaturated carboxylic acids; and e) mixtures thereof.

The polyether diamines are prepared, for example, by reacting polyalkylene glycols with ammonia. The polyalkylene glycols can contain from 2 to 50, preferably to 40, alkylene oxide units. The polyalkylene glycols can, for example, be polyethylene glycols, polypropylene glycols or polybutylene glycols, or block copolymers of ethylene glycol and propylene glycol, block copolymers of ethylene glycol and butylene glycol or block copolymers of ethylene glycol, propylene glycol, and butylene glycol. Apart form the block copolymers, copolymers which are randomly assembled form ethylene oxide and propylene oxide and also, where appropriate, butylene oxide are also suitable for preparing the polyether diamines. In addition, polyether diamines are derived from polytetrahydro-furans which possess from 2 to 75 tetrahydrofuran units. The polytetrahydrofurans are likewise converted by reaction with ammonia into the corresponding α- ω- polyether diamines. Preference is given to using polyethylene glycols or block copolymers of ethylene glycol and propylene glycol for preparing the polyether diamines.

Non-limiting examples of suitable alkylene diamines include ethylenediamine, propylenediamine, 1,4-diaminobutane, and 1,6-diaminohexane. Non-limiting examples of suitable polyalkylene polyamines include diethylenetriamine, triethylenetetramine, dipropylenetriamine, tripropylenetetramine, dihexamethylenetramine, aminopropylethylenediaamine, bis-aminopropylethylenediamine, and polyethyleneimines having $M_w$ up to about 5000 daltons. The herein above described amines are reacted with mono-ethylenically unsaturated carboxylic acids, esters, amides or anhydrides of monoethylenically unsaturated carboxylic acids, such that the resulting products possess at least 2 ethylenically unsaturated double bonds, carboxamide, carboxyl, or ester group, as functional groups. Thus, for example, when the amines or glycols under consideration are reacted with maleic anhydride, compounds are obtained which can, for example, be characterized with the aid of the formula:

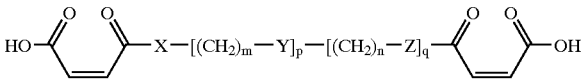

wherein X, and Z are each independently oxygen, —NH—, and mixtures thereof, Y is oxygen, —NH—, —$CH_2$—, and mixtures thereof, m and n are each independently from 0 to 4 and p and q are each independently form 0 to 45,000.

Polyether diamines, alkylene diamines and polyalkylene polyamines can also react with maleic anhydride, or the ethylenically unsaturated carboxylic acids or their derivatives, while adding onto the double bond by means of a Michael addition. Crosslinkers having the formula:

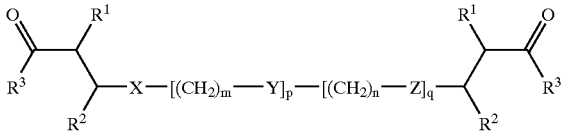

wherein X, and Z are each independently oxygen, —NH—, and mixtures thereof; Y is oxygen, —NH—, —$CH_2$—, and mixtures thereof; $R^1$ is hydrogen, methyl, and mixtures thereof; $R^2$ is hydrogen, —$CO_2R^4$, —$CO_2M$, —$CONH_2$, and mixtures thereof; $R^3$ is —$OR^4$, —$NH_2$, —OH, —OM, and mixtures thereof; $R^4$ is $C_1$–$C_{22}$ alkyl, M is hydrogen or a salt forming cation, preferably Na, K, Mg, Ca, and mixtures thereof; m and n are each independently from 0 to 4 and p and q are each independently form 0 to 45,000.

The herein above described crosslinkers, due to their terminal carboxyl or ester units, and with the formation of an amide function, a crosslinking with the amino groups of the polymers which are produced during the polymerization. This class of crosslinkers also includes the reaction products of monoethylenically unsaturated carboxylic esters with alkylene diamines and polyalkylene polyamines; for example the products which result from the addition of ethylenediamine, diethylenetriamine, having molar masses from 129 to 50,000 to acrylic esters or methacrylic esters, with at least 2 mole of the acrylic ester or methacrylic esters being employed.

An example of a crosslinking unit comprising a polyamine which is reacted with a compound having the formula:

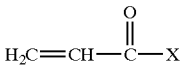

are compounds having the formula:

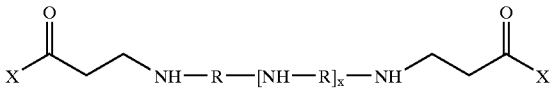

wherein X is —$NH_2$, —OH, —$OR^1$, and mixtures thereof, $R^1$ is $C_1$–$C_{22}$ alkyl.

Crosslinker Group (iv)

A preferred example of a crosslinker which is the reaction product of dicarboxylic acid esters with ethyleneimine, wherein said crosslinkers comprise at least two aziridino units has the formula:

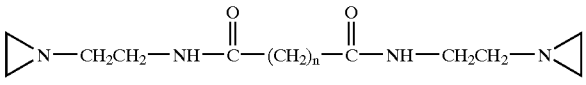

wherein n is from 0 to 22.

Crosslinker Group (v)

Crosslinker group (v) comprises di-epoxies, polyepoxides, α,ω-diisocyanates hexamethylene diisocyanate, inter alia, and polyisocyanates. Non-limiting examples of compounds which comprise the crosslinkers of group (v) include bis-glycidyl ethers of ethylene glycol, polyethylene glycol having 2 to 40 ethylene glycol units, propylene glycol, polypropylene glycol ethers, co-polymers of ethylene oxide and propylene oxide and diisocyanates, inter alia, hexamethylene diisocyanate.

Crosslinker Group (vi)

It is also preferred, according to the present invention to use a mixture of crosslinking units, non limiting examples of which include:

a) mixtures of di-glycidyl ethers of ethylene glycol and bis-chlorohydrin ethers of ethylene glycol;

b) mixtures of di-glycidyl ethers of polyethylene glycols having form 2 to 40 ethylene glycol units with bis-chlorohydrin ethers of polyethylene glycols having from 2 to 40 ethylene glycol units;

c) mixtures of hexamethylene di-isocyanate with propylene carbonate.

The following are non-limiting examples of basic-amino acid containing polymers according to the present invention.

Co-condensates of One or More Basic Amino Acids, Co-Condensable Compounds, or Crosslinking Units (f)

A further aspect of the present invention relates to fabric enhancement compositions which comprise co-condensates of one or more basic amino acids, homo-condensates or co-condensates of basic amino acids, "co-condensable compounds" as defined herein above, and "crosslinking units" as described herein above. In their basic form these compounds are co-polymers produced from the reaction of one or more basic amino acids, homo-condensates or co-condensates of basic amino) acids, "co-condensable compounds" as defined herein above, and "crosslinking units" taken in any order or in any relative amount. For example, the first step may comprise the reaction of one or more basic amino acids with a crosslinking unit which is subsequently followed by the addition of one or more co-condensable compounds. As described herein below, the resulting co-polymers may be optionally alkoxylated.

Alkoxylated Basic Amino Acid-containing Polymers

A preferred embodiment of the present invention comprises homo-condensates, co-condensates, co-polymers produced from the reaction of one or more homo-condensates from (i) or co-condensates from (ii) with one or more co-condensable compounds, and mixtures thereof which are further reacted with one or more alkylene oxides to form alkoxylated polyamines which are suitable for use in the fabric enhancement compositions of the present invention.

The condensed basic amino acid-containing compounds which can be further modified by alkoxylation comprise:

a) condensates of basic amino acids:

i) homo-condensates comprising a single basic amino acid;

ii) co-condensates comprising a mixture of two or more basic amino acids;

b) co-polymers produced from the reaction of one or more basic amino acids and one or more co-condensable compounds;

c) co-polymers produced from the reaction of one or more of the homo-condensates (i) or co-condensates (ii) with one or more co-condensable compounds;

d) crosslinked polymers as described herein; and e) co-condensates formed from the reaction of one or more compounds from (a), (b), (c), or (d).

Non-limiting examples of preferred basic amino acid-containing polymers which are subsequently alkoxylated include polymers which are obtained by reaction of:

a) lysine; and b) at least one compound selected from the group consisting of palmitic acid, stearic acid, lauric acid, octanoic acid, propionic acid, acetic acid, 2-ethylhexanoic acid, adipic acid, succinic acid, citric acid, and mixtures thereof.

The products which are formed from the reaction of the above components preferably comprise a molar ratio of lysine to compounds of group (b) of from 100:1 to 1:10. More preferably it is desirable that the pre-alkoxylated basic amino acid-containing polymer comprise a greater amount of lysine, or any other basic amino acid which comprises group (a), inter alia, ornithine, to have a ratio of the amino acid from (a) to be present in a ratio of at least 1.5: 1. Yet more preferably the elements which comprise (a) are present with respect to the elements which comprise (b) in a ratio greater than or equal to 2:1.

A further non-limiting example of preferred basic amino acid-containing polymers which are subsequently alkoxylated include polymers which are obtained by reaction of:

a) lysine; and b) at least one compound selected from the group consisting of 1,6-hexandiamine. octylamine, aminocaproic acid, aminolauric acid, —-caprolactam, laurolactam, and $C_{14}$–$C_{22}$ alkyldiketenes.

The formulator may substitute for the basic amino acid, lysine, in (a) above, any of the other basic amino acids ornithine, arginine, tryptophan, or mixtures of any or all of the basic amino acids according to the present invention.

The above described preferred basic amino acid-containing polymers which are subsequently alkoxylated can be suitably obtained by any means chosen by the formulator, a non-limiting example of which includes carrying out the reaction in an organic solvent or in an aqueous medium. It is of advantage to conduct the condensation in water at a concentration of the compounds to be condensed of from 10 to 98% by weight, at a temperature of from 120° C. to 300° C. In a preferred embodiment of the process the condensation is carried out in water at a concentration of the compounds to be condensed of from 20 to 70% by weight, under pressure at a temperature of from 140° C. to 250° C. The condensation of these compounds can also be carried out in an organic solvent such as dimethylformamide, dimethylsulfoxide, dimethylacetamide, glycol, polyethylene glycol, propylene glycol, polypropylene glycol, monovalent alcohols, addition products of ethylene oxide and/or propylene oxide to monovalent alcohols, to amines of to carboxylic acids. Some of these solvents may react with the basic amino acids.

Depending upon which elements are selected from groups (a) and (b) and the process chosen by the formulator, the amino groups of the starting material can be present as free amines or in form of their ammonium salts which can be obtained by partial or complete neutralization with a mineral acid, e.g., hydrochloric acid, phosphoric acid, or sulfuric acid, or with an organic acid such as methane sulfonic acid, acetic acid, formic acid, propionic acid, or citric acid.

The prefered basic amino acid-containing polymers of the present invention prior to alkoxylation have a $M_w$ of from about 300 daltons to about 1,000,000 (million) daltons, preferably to about 20,000 daltons, more preferably to about 2,000 daltons.

The basic amino acid comprising polymers once formed, are suitably modified by alkoxylation such that they comprise alkyleneoxy units obtained by the reaction of said polymers with $C_2$–$C_{30}$ alkylene oxides, styrene oxide, and mixtures thereof The alkylene oxides are preferably selected from the group consisting of ethylene oxide, propylene oxide, butylene oxide, and mixtures thereof. The "alkoxylates" defined herein as "basic amino acid-containing polymers wherein the hydrogen atoms of primary amino units, —$NH_2$ units, and secondary amino units, —NH units, are replaced by alkyleneoxy units having the formula —$(RO)_xH$ wherein R is $C_2$–$C_{30}$ alkylene and x has an average value of from 0.1, preferably from 0.5 to 100, preferably to 30". These values of alkoxylation can be suitably obtained by reaction of the starting polyamine with from 0.1 moles, preferably 0.5 moles to 100, preferably to 30 moles of an alkylene oxide added, i.e., in condensed form. The most preferred altylene oxides are ethylene oxide, propylene oxide, and mixtures thereof. Most preferred are polymers which comprise from about 0.7 to about 2.5 alkyleneoxy units per replaced hydrogen atom and polymers which comprise from about 17 to about 25 alkyleneoxy units per replaced hydrogen atom.

In addition, crosslinked basic amino acid-containing polymers according to the present invention may be suitably alkoxylated, or alternatively, basic amino acid-containing polymers may be suitably alkoxylated then subsequently crosslinked according to the herein described procedures.

The following are non-limiting examples of alkoxylated basic-amino acid containing polymers according to the present invention.

EXAMPLE 1

Homo-condensate of L-lysine

L-lysine monohydrate (821 g, 5.0 mol) and sodium hypophosphite (0.1 g) are placed in a pressurizable 2.5 l reaction vessel and blanketed with nitrogen. The reaction vessel is then sealed and the contents heated at 200° C. for 6 h, during which time the internal pressure rose to 11.2 bar. The pressure is then slowly released to remove water from the reaction mixture. The reaction temperature is maintained at 200° C. for 0.5 h to remove residual amounts of solvent and volatile products. The reaction mixture is then stirred at 200° C. for 25 minutes at 20 mbar of pressure, after which the viscous melt is cooled to 115° C., removed from the reaction vessel and subsequently cooled to ambient temperature. The resulting lysine homo-condensate has a $M_w$ of 4300 daltons.

EXAMPLE 2

Co-polymer Comprising L-lysine and Aminocatroic Acid in Molar Ratio of 1:1

L-lysine monohydrate (656.8 g, 4.0 mol), aminocaproic acid (524.7 g, 4.0 mol) and sodium hypophosphite (0.1 g) are placed in a pressurizable 2.5 l reaction vessel and blanketed with nitrogen. The reaction vessel is then sealed and the contents heated at 196° C. for 7 h, during which time the internal pressure rose to 8.2 bar. The pressure is then slowly released to remove water and volatile products from the reaction mixture. The resulting viscous melt is removed from the reaction vessel and subsequently cooled to ambient temperature. The resulting co-condensate has a $M_w$ of 7400 daltons.

EXAMPLE 3

Co-polymer Comprising L-lysine and Hexamethylenediamine in Molar Ratio of 5:1

L-lysine monohydrate (492.6 g, 3.0 mol), hexamethylenediamine (69.6 g, 0.6 mol) and sodium hypophosphite (0.1 g) are placed in a pressurizable 2.5 l reaction vessel and blanketed with nitrogen. The reaction vessel is then sealed and the contents heated at 180° C. for 6 h, during which time the internal pressure rose to 4.1 bar. The pressure is then slowly released to remove water and volatile products from the reaction mixture. The reaction mixture is then stirred at 180° C. for 30 minutes at atmospheric pressure, after which the viscous melt is cooled to 90° C., removed from the reaction vessel and subsequently cooled to ambient temperature. The resulting lysine homo-condensate has a $M_w$ of 5140 daltons.

EXAMPLE 4

Crosslinking of (5:1) L-lysine/hexamethylenediamine Co-polymer with bis-glycidyl Ether of Polyethylene Glycol Having 14 Ethylene Glycol Units A 25% by weight aqueous solution bis-glycidyl ether of polyethylene glycol having 14 ethylene glycol units (12 g) is added slowly to a 25% by weight aqueous solution of the co-condensate from Example 3 (40 g) at 25° C. The reaction mixture is heated to 65° C. and stirred for 1 h. The resulting viscous solution is cooled to ambient temperature and the pH adjusted to 7.5 by the addition of 1 g of sulfuric acid to yield a highly viscous, orange solution.

EXAMPLE 5

Homo-condensate of L-lysine Having an Average of 2 Ethyleneoxy Units per —NH Unit A 56.8% by weight aqueous solution of the homo-condensate from Example 1 (400 g) is charged to a pressurizable 3.5 1 reaction vessel and blanketed with nitrogen. The reaction vessel is heated to 120° C. Ethylene oxide (100 g, 2.27 mole) is added during which time the internal pressure rises to 8.0 bar. The reaction solution is held at 120° C. for 2 h, cooled to ambient temperature then opened to the atmosphere. Removal of water and volatile products in vacuo yields 317 g of a viscous, orange solution.

EXAMPLE 6

Homo-condensate of L-lysine Having an Average of 20 Ethyleneoxy Units per —NH Unit The homo-condensate from Example 1 (150 g) and potassium hydroxide (5.3 g) are charged to a pressurizable 3.5 l reaction vessel and blanketed with nitrogen. The reaction vessel is heated to 120° C. Ethylene oxide (916 g, 20.8 mole) is added over a period of 2 h during which time the internal pressure rises to 8.0 bar. The reaction'solution is held at 120° C. for 18 h, cooled to ambient temperature then opened to the atmosphere. Removal of water and volatile products in vacuo yields 1051 g of a viscous, dark orange solution oil.

EXAMPLE 7

Co-polymer Comprising L-lysine and Aminocaproic Acid in Molar Ratio of 1:1 Having an Average of 1.6 Propyleneoxy Units per —NH Unit The co-condensate from Example 2 (300 g) is dissolved in methanol (300 mL), charged to a pressurizable 3.5 l reaction vessel and blanketed with nitrogen. The reaction vessel is then heated to 100° C./Propylene oxide (115 g, 1.98 mol) is added during which time the pressure rises to 4.6 bar. She reaction mixtures is held at 100° C. for 18 h, cooled to ambient temperature and the pressure released. Removal of water and volatile products in vacuo yields 374 g of a viscous, dark orange solution oil.

FABRIC ENHANCEMENT COMPOSITIONS

The present invention relates to fabric enhancement compositions which comprise:

A) from about 0.1%, preferably from about 1%, more preferably from 2.5% to about 30%, preferably to about 20%, more preferably to about 10% by weight, of a polymeric material selected from the group consisting of:
   a) homo-condensates of basic amino acid, said amino acids selected from the group consisting of lysine, ornithine, arginine, and tryptophan;
   b) co-condensates of basic amino acids, said amino acids selected from the group consisting of lysine, ornithine, arginine, and tryptophan;
   c) co-polymers produced from the reaction of one or more basic amino acids with one or more co-condensable compounds;
   d) co-polymers produced from the reaction of one or more homo-condensates from (a) or co-condensates from (b) with one or more co-condensable compounds:
   e) crosslinked basic amino acid-containing polymers, said crosslinked polymers comprising:
      i) one or more basic amino acids;
      ii) co-polymers of (i) and one or more co-condensable compounds;
      iii) optionally co-polymers produced from the reaction of one or more homo-condensates from (a) or co-condensates from (b) with one or more co-condensable compounds; and
      iv) one or more crosslinking unit;
      wherein at least one crosslinking unit is derived from a crosslinker which comprises at least two functional groups;
   f) co-condensates formed from the reaction of one or more compounds selected from the group consisting of:
      i) basic amino acids;
      ii) co-condensable compounds;
      iii) crosslinking agents:
   g) optionally said homo-condensates from (a), co-condensates from (b), co-polymers from (c) and (d), crosslinked polymers from (e), and co-condensates from (t), are alkoxylated with from an average of 0.1 to about 30 alkyleneoxy units; and
   h) mixtures thereof;

B) optionally from about 0.01% by weight, of a fabric abrasion polymer comprising:
   i) at least one monomeric unit comprising an amide moiety;
   ii) at least one monomeric unit comprising an N-oxide moiety;
   iii) and mixtures thereof;

C) optionally from about 1%, preferably from about 10%, more preferably from about 20% to about 80%, preferably to about 60%, more preferably to about 45% by weight, of a fabric softening active;

D) optionally less than about 15% by weight, of a principal solvent, preferably said principal solvent has a ClogP of from about 0.1 to about 1;

E) optionally from about 0.001% to about 90% by weight, of one or more dye fixing agents;

F) optionally from about 0.01% to about 50% by weight, of one or more cellulose reactive dye fixing agents;

G) optionally from about 0.01% to about 15% by weight, of a chlorine scavenger;

H) optionally about 0.005% to about 1% by weight, of one or more crystal growth inhibitors;

I) optionally from about 1% to about 12% by weight, of one or more liquid carriers;

J) optionally from about 0.001% to about 1% by weight, of an enzyme;

K) optionally from about 0.01% to about 8% by weight, of a polyolefin emulsion or suspension;

L) optionally from about 0.0 1% to about 0.2% by weight, of a stabilizer;

M) from about 0.01% by weight, of one or more linear or cyclic polyamines which provide bleach protection; and N) the balance carrier and adjunct ingredients.

The fabric care compositions of the present invention comprise one or more polyamino acid polymers as described herein. For the purposes of the present invention the terms "fabric enhancement compositions" and "fabric care compositions" are used interchangeably throughout the present specification and stand equally well for one another and are defined as "compositions which provides care or enhancement to the fabric non-limiting examples of which include stand-alone compositions, detergent adjuncts, fabric softening compositions inter alia rinse-added softening composition, dryer-added softening compositions". The compositions of the present invention provide an efficient fabric abrasion reduction. The term "efficient fabric abrasion reduction" is defined herein as "fabric which has been treated by the herein described compositions have an improved appearance relative to fabrics which have been un-treated by the herein disclosed compositions.

The following are non-limiting examples of ingredients which can be combined with the polyamino acid polymers of the present invention.

Fabric Abrasion Reducing Polymers

The compositions of the present invention comprise from about 0.01%, preferably from about 0.1% to about 20%, preferably to about 10% by weight, of a fabric anti-abrasion reducing polymer.

The prefered reduced abrasion polymers of the present invention arc water-soluble polymers. For the purposes of the present invention the term "water-soluble" is defined as "a polymer which when dissolved in water at a level of 0.2% by weight, or less, at 25° C., forms a clear, isotropic liquid".

The fabric abrasion reducing polymers useful in the present invention have the formula:

$$[-P(D)_m-]_n$$

wherein the unit P is a polymer backbone which comprises units which are homopolymeric or copolymeric. D units are defined herein below. For the purposes of the present invention the term "homopolymeric" is defined as "a polymer backbone which is comprised of units having the same unit composition, i.e., formed from polymerization of the same monomer". For the purposes of the present invention the term "copolymeric" is defined as "a polymer backbone which is comprised of units having a different unit composition, i.e., formed from the polymerization of two or more monomers".

P backbones preferably comprise units having the formula:

$$-[CR_2-CR_2]- \text{ or } -[(CR_2)_x-L]-$$

wherein each R unit is independently hydrogen, $C_1$–$C_{12}$ alkyl, $C_6$–$C_{12}$ aryl, and D units as described herein below; preferably $C_1$–$C_4$ alkyl.

Each L unit is independently selected from heteroatom-containing moieties, non-limiting examples of which are selected from the group consisting of:

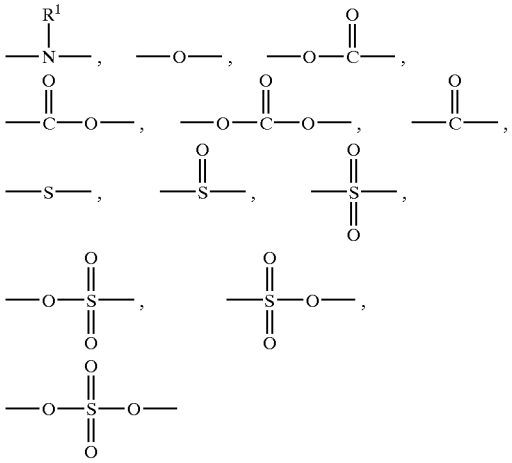

polysiloxane having the formula:

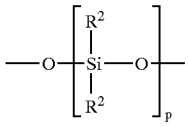

wherein the index p is from 1 to about 6; units which have dye transfer inhibition activity:

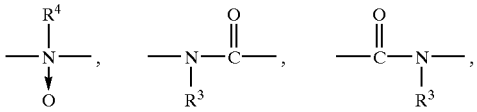

and mixtures thereof; wherein $R^1$ is hydrogen, $C_1$–$C_{12}$ alkyl, $C_6$–$C_{12}$ aryl, and mixtures thereof. $R^2$ is $C_1$–$C_{12}$ alkyl, $C_1$–$C_{12}$ alkoxy, $C_6$–$C_{12}$ aryloxy, and mixtures thereof; preferably methyl and methoxy. $R^3$ is hydrogen $C_1$–$C_{12}$ alkyl, $C_6$–$C_{12}$ aryl, and mixtures thereof; preferably hydrogen or $C_1$–$C_4$ alkyl, more preferably hydrogen. $R^4$ is $C_1$–$C_{12}$ alkyl, $C_6$–$C_{12}$ aryl, and mixtures thereof.

The backbones of the fabric abrasion reducing polymers of the present invention comprise one or more D units which are units which comprise one or more units which provide a dye transfer inhibiting benefit. The D unit can be part of the backbone itself as represented in the general formula:

$$[—P(D)_m—]_n$$

or the D unit may be incorporated into the backbone as a pendant group to a backbone unit having, for example, the formula:

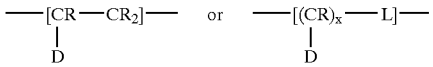

However, the number of D units depends upon the formulation. For example, the number of D units will be adjusted to provide water solubility of the polymer as well as efficacy of dye transfer inhibition while providing a polymer which has fabric abrasion reducing properties. The molecular weight of the fabric abrasion reducing polymers of the present invention are from about 500, preferably from about 1,000, more preferably from about 100,000 most preferably from 160,000 to about 6,000,000, preferably to about 2,000,000, more preferably to about 1,000,000, yet more preferably to about 500,000, most preferably to about 360,000 daltons. Therefore the value of the index n is selected to provide the indicated molecular weight, and providing for a water solubility of least 100 ppm, preferably at least about 300 ppm, and more preferably at least about 1,000 ppm in water at ambient temperature which is defined herein as 25° C.

Polymers Comprising Amide Units

Non-limiting examples of preferred D units are D units which comprise an amide moiety. Examples of polymers wherein an amide unit is introduced into the polymer via a pendant group includes polyvinylpyrrolidone having the formula:

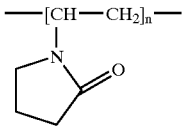

polyvinyloxazolidone having the formula:

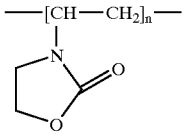

polyvinylmethyloxazolidone having the formula:

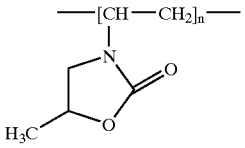

polyacrylamides and N-substituted polyacrylamides having the formula:

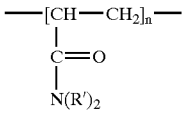

wherein each R' is independently hydrogen, $C_1$–$C_6$ alkyl, or both R' units can be taken together to form a ring comprising 4–6 carbon atoms; polymethacrylamides and N-substituted polymethacrylamides having the general formula:

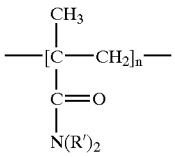

wherein each R' is independently hydrogen, $C_1$–$C_6$ alkyl, or both R' units can be taken together to form a ring comprising 4–6 carbon atoms; poly(N-acrylylglycinamide) having the formula:

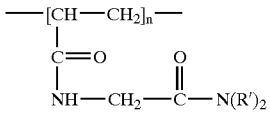

wherein each R' is independently hydrogen, $C_1$–$C_6$ alkyl, or both R' units can be taken together to form a ring comprising 4–6 carbon atoms; poly(N-methacrylylglycinamide) having the formula:

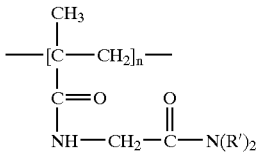

wherein each R' is independently hydrogen, $C_1$–$C_6$ alkyl, or both R' units can be taken together to form a ring comprising 4–6 carbon atoms; polyvinylurethanes having the formula:

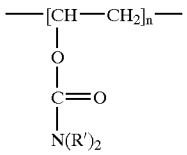

wherein each R' is independently hydrogen, $C_1$–$C_6$ alkyl, or both R' units can be taken together to form a ring comprising 4–6 carbon atoms.

An example of a D unit wherein the nitrogen of the dye transfer inhibiting moiety is incorporated into the polymer backbone is a poly(2-ethyl-2-oxazoline) having the formula:

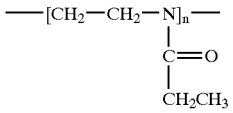

wherein the index n indicates the number of monomer residues present.

The fabric abrasion reducing polymers of the present invention can comprise any mixture of dye transfer inhibition units which provides the product with suitable properties. The preferred polymers which comprise D units which are amide moieties are those which have the nitrogen atoms of the amide unit highly substituted so the nitrogen atoms are in effect a shielded to a varying degree by the surrounding non-polar groups. This provides the polymers with an amphiphilic character. Non-limiting examples include polyvinyl-pyrrolidones, polyvinyloxazolidones, N,N-disubstituted polyacrylamides, and N,N-disubstituted polymethacrylamides. A detailed description of physicochemical properties of some of these polymers are given in "Water-Soluble Synthetic Polymers: Properties and Behavior", Philip Molyneux, Vol. 1, CRC Press, (1983) included herein by reference.

The amide containing polymers may be present partially hydrolyzed and/or crosslinked forms. A preferred polymeric compound for the present invention is polyvinylpyrrolidone (PVP). This polymer has an amphiphilic character with a highly polar amide group conferring hydrophilic and polar-attracting properties, and also has non-polar methylene and methine groups, in the backbone and/or the ring, conferring hydrophobic properties. The rings may also provide planar alignment with the aromatic rings in the dye molecules. PVP is readily soluble in aqueous and organic solvent systems. PVP is available ex ISP, Wayne, N.J. and BASF Corp., Parsippany, New Jersey, as a powder or aqueous solutions in several viscosity grades, designated as, e.g., K-12, K-15, K-25, and K-30. These K-values indicate the viscosity average molecular weight, as shown below:

| PVP viscosity average molecular | K-12 | K-15 | K-25 | K-30 | K-60 | K-90 |
|---|---|---|---|---|---|---|
| weight (in thousands of daltons) | 2.5 | 10 | 24 | 40 | 160 | 360 |

PVP K-12, K-15, and K-30 are also available ex Polysciences, Inc. Warrington, Pa., PVP K-15, K-25, and K-30 and poly(2-ethyl-2-oxazoline) are available ex Aldrich Chemical Co., Inc., Milwaukee, Wis. PVP K30 (40,000) through to K90 (360,000) are also commercially available ex BASF under the tradename Luviskol or commercially available ex ISP. Still higher molecular PVP like PVP 1.3MM, commercially available ex Aldrich is also suitable for use herein. Yet further PVP-type of material suitable for use in the present invention are polyvinylpyrrolidone-co-dimethylaminoethylmethacrylate, commercially available commercially ex ISP in a quaternised form under the tradename Gafquat® or commercially available ex Aldrich Chemical Co. having a molecular weight of approximately 10 MM; polyvinylpyrrolidone-co-vinyl acetate, available ex BASF under the tradename Luviskol®, available in vinylpyrrolidone:vinylacetate ratios of from 3:7 to 7:3.

Polymers Comprising N-oxide Units

Another D unit which provides dye transfer inhibition enhancement to the fabric abrasion reducing polymers described herein, are N-oxide units having the formula:

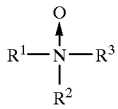

wherein $R^1$, $R^2$, and $R^3$ can be any hydrocarbyl unit (for the purposes of the present invention the term "hydrocarbyl" does not include hydrogen atom alone). The N-oxide unit may be part of a polymer, such as a polyamine, i.e., polyalkyleneamine backbone, or the N-oxide may be part of a pendant group attached to the polymer backbone. An example of a polymer which comprises an the N-oxide unit as a part of the polymer backbone is polyethyleneimine N-oxide. Non-limiting examples of groups which can comprise an N-oxide moiety include the N-oxides of certain heterocycles inter alia pyridine, pyrrole, imidazole, pyrazole, pyrazine, pyrimidine, pyridazine, piperidine, pyrrolidine, pyrrolidone, azolidine, morpholine. A preferred polymer is poly(4-vinylpyriding N-oxide, PVNO). In addition, the N-oxide unit may be pendant to the ring, for example, aniline oxide.

N-oxide comprising polymers of the present invention will preferably have a ration of N-oxidized amine nitrogen to non-oxidized amine nitrogen of from about 1:0 to about 1:2, preferably to about 1:1, more preferably to about 3:1. The amount of N-oxide units can be adjusted by the formulator. For example, the formulator may co-polymerize N-oxide comprising monomers with non N-oxide comprising monomers to arrive at the desired ratio of N-oxide to non N-oxide amino units, or the formulator may control the oxidation level of the polymer during preparation. The amine oxide unit of the polyamine N-oxides of the present invention have a $Pk_2$ less than or equal to 10, preferably less than or equal to 7, more preferably less than or equal to 6. The average molecular weight of the N-oxide comprising polymers which provide a dye transfer inhibitor benefit to reduced fabric abrasion polymers is from about 500 daltons, preferably from about 100,000 daltons, more preferably from about 160,000 daltons to about 6,000,000 daltons, preferably to about 2,000,000 daltons, more preferably to about 360,000 daltons.

Polymers Comprising Amide Units and N-oxide Units

A further example of polymers which are fabric abrasion reducing polymers which have dye transfer inhibition benefits are polymers which comprise both amide units and N-oxide units as described herein above. Non-limiting examples include co-polymers of two monomers wherein the first monomer comprises an amide unit and the second monomer comprises an N-oxide unit. In addition, oligomers or block polymers comprising these units can be taken together to form the mixed amide/N-oxide polymers. However, the resulting polymers must retain the water solubility requirements described herein above.

Molecular Weight

For all the above described fabric abrasion reducing polymers of the invention, it is most preferred that they have a molecular weight in the range as described herein above. This range is typically higher than the range for polymers which render only dye transfer inhibition benefits alone. Indeed, the higher molecular weight of the abrasion reducing polymers provides for reduction of fabric abrasion which typically occurs subsequent to treatment, for example during garment use, especially in a later washing procedure. Not to be bound by theory, it is believed that the high molecular weight enables the deposition of the polymer on the fabric surface and provides sufficient substantivity so that the polymer is capable of remaining on the fabric during subsequent use and subsequent laundering of the fabric. Further, it is believed that for a given charge density, increasing the molecular weight will increase the substantivity of the polymer to the fabric surface. Ideally the balance of charge density and molecular weight will provide both a sufficient rate of deposition onto the fabric surface and a sufficient attraction to the fabric during subsequent wash cycles. Increasing molecular weight is considered preferable to increasing charge density as it allows a greater choice in the range of materials which can provide the desired benefit and avoids the negative impact that increasing charge density may have inter alia the attraction of soil and residue onto treated fabrics. It should be noted, however, that a similar benefit may be predicted from the approach of increasing charge density while retaining a lower molecular weight material.

Dye Fixing Agents

The compositions of the present invention optionally comprise from about 0.001%, preferably from about 0.5% to about 90%, preferably to about 50%, more preferably to about 1%, most preferably to about 5% by weight, of one or more dye fixing agents.

Dye fixing agents, or "fixatives", are well-known, commercially available materials which are designed to improve the appearance of dyed fabrics by minimizing the loss of dye from fabrics due to washing. Not included within this definition are components which can in some embodiments serve as fabric softener actives.

Many dye fixing agents are cationic, and are based on quaternized nitrogen compound or on nitrogen compounds having a strong cationic charge which is formed in situ under the conditions of usage. Cationic fixatives are available under various trade names from several suppliers. Representative examples include: CROSCOLOR PMF (July 1981, Code No. 7894) and CROSCOLOR NOFF (January 1988, Code No. 8544) ex Crosfield; INDOSOL E-50 (Feb. 27, 1984, Ref. No. 6008.35.84; polyethyleneamine-based) ex Sandoz; SANDOFIX TPS, ex Sandoz, is a preferred dye fixative for use herein. Additional non-limiting examples include SANDOFIX SWE (a cationic resinous compound) ex Sandoz, REWIN SRF, REWIN SRF-O and REWIN DWR ex CHT-Beitlich GMBH; Tinofix® ECO, Tinofix® FRD and Solfin(® ex Ciba-Geigy. A preferred dye fixing agent for use in the compositions of the present invention is CARTAFIX CB® ex Clariant.

Other cationic dye fixing agents are described in "After-treatments for Improving the Fastness of Dyes on Textile Fibres", Christopher C. Cook, *Rev. Prog. Coloration*, Vol. XII, (1982). Dye fixing agents suitable for use in the present invention are ammonium compounds such as fatty acid-diamine condensates inter alia the hydrochloride, acetate, metosulphate and benzyl hydrochloride salts of diamine esters. Non-limiting examples include oleyldiethyl aminoethylamide, oleylmethyl diethylenediamine methosulphate, monostearylethylene diaminotrimethylammonium methosulphate. In addition, the N-oxides of tertiary amines;

derivatives of polymeric alkyldiamines, polyamine-cyanuric chloride condensates, and aminated glycerol dichlorohydrins are suitable for use as dye fixatives in the compositions of the present invention.

Cellulose Reactive Dye Fixing Agents

Another dye fixing agent suitable for use in the present invention are cellulose reactive dye fixing agents. The compositions of the present invention optionally comprise from about 0.01%, preferably from about 0.05%, more preferably from about 0.5% to about 50%, preferably to about 25%, more preferably to about 10% by weight, most preferably to about 5% by weight, of one or more cellulose reactive dye fixing agents. The cellulose reactive dye fixatives may be suitably combined with one or more dye fixatives described herein above in order to comprise a "dye fixative system".

The term "cellulose reactive dye fixing agent" is defined herein as "a dye fixative agent which reacts with the cellulose fibers upon application of heat or upon a heat treatment either in situ or by the formulator". The cellulose reactive dye fixing agents suitable for use in the present invention can be defined by the following test procedure.

Cellulose Reactivity Test (CRT)

Four pieces of fabric which are capable of bleeding their dye (e.g. 10×10 cm of knitted cotton dyed with Direct Red 80) are selected. Two swatches are used as a first control and a second control, respectively. The two remaining swatches are soaked for 20 minutes in an aqueous solution containing 1% (w/w) of the cellulose reactive dye fixing agent to be tested. The swatches are removed and thoroughly dried. One of the treated swatches which has been thoroughly dried, is passed ten times through an ironing calender which is adjusted to a "linen fabric" temperature setting. The first control swatch is also passed ten times through an ironing calender on the same temperature setting.

All four swatches (the two control swatches and the two treated swatches, one of each which has been treated by the ironing calender) are washed separately in Launder-O-Meter pots under typical conditions with a commercial detergent used at the recommended dosage for ½ hour at 60° C., followed by a thorough rinsing of 4 times 200 ml of cold water and subsequently line dried.

Color fastness is then measured by comparing the DE values of a new untreated swatch with the four swatches which have undergone the testing. DE values, the computed color difference, is defined in ASTM D2244. In general, DE values relate to the magnitude and direction of the difference between two psychophysical color stimuli defined by tristimulus values, or by chromaticity coordinates and luminance factor, as computed by means of a specified set of color-difference equations defined in the CIE 1976 CIELAB opponent-color space, the Hunter opponent-color space, the Friele-Mac Adam-Chickering color space or any equivalent color space. For the purposes of the present invention, the lower the DE value for a sample, the closer the sample is to the un-tested sample and the greater the color fastness benefit.

As the test relates to selection or a cellulose reactive dye fixing agent, if the DE value for the swatch treated in the ironing step has a value which is better than the two control swatches, the candidate-is a cellulose reactive dye fixing agent for the purposes of the invention.

Typically cellulose reactive dye fixing agents are compounds which contain a cellulose reactive moiety, non limiting examples of these compounds include halogenotriazines, vinyl sulphones, epichlorhydrine derivatives, hydroxyethylene urea derivatives, formaldehyde condensation products, polycarboxylates, glyoxal and glutaraldehyde derivatives, and mixtures thereof. Further examples can be found in "Textile Processing and Properties", Tyrone L. Vigo, at page 120 to 121, Elsevier (1997), which discloses specific electrophilic groups and their corresponding cellulose affinity.

Preferred hydroxyethylene urea derivatives include dimethyloldihydroxyethylene, urea, and dimethyl urea glyoxal. Preferred formaldehyde condensation products include the condensation products derived from formaldehyde and a group selected from an amino-group, an imino-group, a phenol group, an urea group, a cyanamide group and an aromatic group. Commercially available compounds among this class are Sandofix WE 56 ex Clariant, Zetex E ex Zeneca and Levogen BF ex Bayer. Preferred polycarboxylates derivatives include butane tetracarboxilic acid derivatives, citric acid derivatives, polyacrylates and derivatives thereof A most preferred cellulosic reactive dye fixing agents is one of the hydroxyethylene urea derivatives class commercialized under the tradename of Indosol CR ex Clariant. Still other most preferred cellulosic reactive dye fixing agents are commercialized under the tradename Rewin DWR and Rewin WBS ex CHT R. Beitlich.

Chlorine Scavengers

The compositions of the present invention optionally comprise from about 0.01%, preferably from about 0.02%, more preferably from about 0.25% to about 15%, preferably to about 10%, more preferably to about 5% by weight, of a chlorine scavenger. In cases wherein the cation portion and the anion portion of the non-polymeric scavenger each react with chlorine, the amount of scavenger can be adjusted to fit the needs of the formulator.

Suitable chlorine scavengers include ammonium salts having the formula:

$$[(R)_3R^1N]^+X^-$$

wherein each R is independently hydrogen, $C_1$–$C_4$ alkyl, $C_1$–$C_4$ substituted alkyl, and mixtures thereof, preferably R is hydrogen or methyl, more preferably hydrogen. R' is hydrogen $C_1$–$C_9$ alkyl, $C_1$–$C_9$ substituted alkyl, and mixtures thereof, preferably R is hydrogen. X is a compatible anion, non-limiting examples include chloride, bromide, citrate, sulfate; preferably X is chloride.

Non-limiting examples of preferred chlorine scavengers includ ammonium chloride, ammonium sulfate, and mixtures thereof; preferably ammonium chloride.

Crystal Growth Inhibitor

The compositions of the present invention optionally comprise from about 0.005%, preferably from about 0.5%, more preferably from about 0.1% to about 1%, preferably to about 0.5%, more preferably to about 0.25%, most preferably to about 0.2% by weight, of one or more crystal growth inhibitors. The following "Crystal Growth Inhibition Test" is used to determine the suitability of a material for use as a crystal growth inhibitor.

Crystal Growth Inhibition Test (CGIT)

The suitability of a material to serve as a crystal growth inhibitor according to the present invention can be determined by evaluating in vitro the growth rate of certain inorganic micro-crystals. The procedure of Nancollas et al., described in "Calcium Phosphate Nucleation and Growth in Solution", *Prog. Crystal Growth Charact.*, Vol 3, 77–102, (1980), incorporated herein by reference, is a method which is suitable for evaluating compounds for their crystal growth inhibition. The graph below serves as an example of a plot indicating the time delay (i-lag) in crystal formation afforded by a hypothetical crystal growth inhibitor.

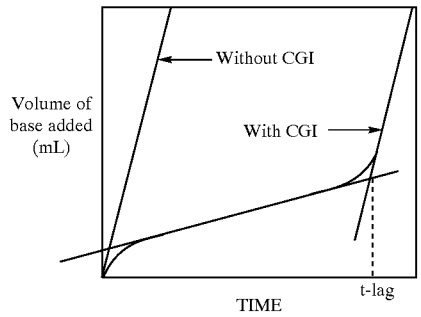

The observed t-lag provides a measure of the compound's efficiency with respect to delaying the growth of calcium phosphate crystal. The greater the t-lag, the more efficient the crystal growth inhibitor.

Exemplary Procedure

Combine in a suitable vessel, 2.1M KCl (35 mL), 0.0175M $CaCl_2$ (50 mL), 0.001M $KH_2PO_4$ (50 mL), and de-ionized water (350 mL). A standard pH electrode equipped with a Standard Calomel Reference electrode is inserted and the temperature adjusted to 37° C. while purging of the solution of oxygen. Once the temperature and pH are stabilized, a solution of the crystal growth inhibitor to be test is then added. A typical inhibitor test concentration is $1\times10^{-6}$ M. The solution is titrated to pH 7.4 with 0.05M KOH. The mixture is then treated with 5 mL's of a hydroxyapatite slurry. The hydroxyapatite slurry can be prepared by digesting Bio-Gel® HTP hydroxyapatite powder (100 g) in 1 L of distilled water the pH of which is adjusted to 2.5 by the addition of sufficient 6N HCl and subsequently heating the solution until all of the hydroxyapatite is dissolved (heating for several days may be necessary). The temperature of the solution is then maintained at about 22° C. while the pH is adjusted to 12 by the addition of a solution of 50% aqueous KOH. Once again the solution is heated and the resulting slurry is allowed to settle for two days before the supernatant is removed. 1.5 L of distilled water is added, the solution stirred, then after settling again for 2 days the supernatant is removed. This rinsing procedure is repeated six more time after which the pH of the solution is adjusted to neutrality using 2N HCl. The resulting slurry can be stored at 37° C. for eleven months.

Crystal growth inhibitors which are suitable for use in the present invention have a t-lag of at least 10 minutes, preferably at least 20 minutes, more preferably at least 50 minutes, at a concentration of $1\times10^{-6}$M. Crystal growth inhibitors are differentiated form chelating agents by the fact that crystal growth inhibitors have a low binding affinity of heavy metal ions, i.e., copper. For example, crystal growth inhibitors have an affinity for copper ions in a solution of 0.1 ionic strength when measured at 25° C., of less than 15, preferably less than 12.

The preferred crystal growth inhibitors of the present invention are selected from the group consisting of carboxylic compounds, organic diphosphonic acids, and mixtures thereof. The following are non-limiting examples of preferred crystal growth inhibitors.

Carboxylic Compounds

Non-limiting examples of carboxylic compounds which serve as crystal growth inhibitors include glycolic acid, phytic acid, polycarboxylic acids, polymers and co-polymers of carboxylic acids and polycarboxylic acids, and mixtures thereof. The inhibitors may be in the acid or salt form. Preferably the polycarboxylic acids comprise materials having at least two carboxylic acid radicals which are separated by not more than two carbon atoms (e.g., methylene units). The preferred salt forms include alkali metals; lithium, sodium, and potassium; and alkanolammonium. The polycarboxylates suitable for use in the present invention are further disclosed in U.S. Pat. No. 3,128,287, U.S. Pat. No. 3,635,830, U.S. Pat. No. 4,663,071, U.S. Pat. No. 3,923,679; U.S. Pat. No. 3,835,163; U.S. Pat. No. 4,158,635; U.S. Pat. No. 4,120,874 and U.S. Pat. No. 4,102,903, each of which is included herein by reference.

Further suitable polycarboxylates include ether hydroxypolycarboxylates, polyacrylate polymers, copolymers of maleic anhydride and the ethylene ether or vinyl methyl ethers of acrylic acid. Copolymers of 1,3,5-trihydroxybenzene, 2,4,6-trisulphonic acid, and carboxymethyloxysuccinic acid are also useful. Alkali metal salts of polyacetic acids, for example, ethylenediamine tetraacetic acid and nitrilotriacetic acid, and the alkali metal salts of polycarboxylates, for example, mellitic acid, succinic acid, oxydisuccinic acid, polymnaleic acid, benzene 1,3,5-tricarboxylic acid, carboxymethyloxysuccinic acid, are suitable for use in the present invention as crystal growth inhibitors.

The polymers and copolymers which are useful as crystal growth inhibitors have a molecular weight which is preferably greater than about 500 daltons to about 100,000 daltons, more preferably to about 50,000 daltons.

Examples of commercially available materials for use as crystal growth inhibitors include, polyacrylate polymers Good-Rite® ex BF Goodrich, Acrysol® ex Rohm & Haas, Sokalan® ex BASF, and Norasol®9 ex Norso Haas. Preferred are the Norasol®(9 polyacrylate polymers, more preferred are Norasol®9 410N (MW 10,000) and Norasol® 440N (MW 4000) which is an amino phosphonic acid modified polyacrylate polymer, and also more preferred is the acid form of this modified polymer sold as Norasol® QR 784 (MW 4000) ex Norso-Haas.

Polycarboxylate crystal growth inhibitors include citrates, e.g., citric acid and soluble salts thereof (particularly sodium salt), 3,3-dicarboxy 4oxa-1,6-hexanedioates and related compounds further disclosed in U.S. Pat. No. 4,566,984 incorporated herein by reference, $C_5$-$C_{20}$ alkyl, $C_5$–$C_{20}$ alkenyl succinic acid and salts thereof, of which dodecenyl succinate, lauryl succinate, myristyl succinate, palmityl succinate, 2-dodecenylsuccinate, 2-pentadecenyl succinate, are non-limiting examples. Other suitable polycarboxylates are disclosed in U.S. Pat. No. 4,144,226, U.S. Pat. No. 3,308,067 and U.S. Pat. No. 3,723,322, all of which are incorporated herein by reference.

Organic Phosphonic Acids

Organic diphosphonic acid are also suitable for use as crystal growth inhibitors. For the purposes of the present invention the term "organic diphosphonic acid" is defined as "an organo-diphosphonic acid or salt which does not comprise a nitrogen atom". Preferred organic diphosphonic acids include $C_1$–$C_4$ diphosphonic acid, preferably $C_2$ diphosphonic acid selected from the group consisting of ethylene diphosphonic acid, a-hydroxy-2 phenyl ethyl diphosphonic acid, methylene diphosphonic acid, vinylidene-1,1-diphosphonic acid, 1,2-dihydroxyethane-1,1-iphosphonic acid, hydroxy-ethane 1,1 diphosphonic acid, the salts thereof, and mixtures thereof more preferred is hydroxyethane-1,1-diphosphonic acid (HEDP).

A more preferred phosphonic acid 1,2-phosphonobutane-1,2,4-tricarboxylic acid (PBTC) available as Bayhibit® AM ex Bayer.

Fabric Softening Actives

The compositions of the present invention optionally comprise at least about 1%, preferably from about 10%, more preferably from about 20% to about 80%, more preferably to about 60%, most preferably to about 45% by weight, of the composition of one or more fabric softener actives.

The preferred fabric softening actives according to the present invention are amines having the formula:

$$(R)_{3-m}N-\left[(CH_2)_n-Q-R^1\right]_m,$$

quaternary ammonium compounds having the formula:

$$\left[(R)_{4-m}\overset{+}{N}-\left[(CH_2)_n-Q-R^1\right]_m\right]X^-,$$

and mixtures thereof, wherein each R is independently $C_1$–$C_6$ alkyl, $C_1$–$C_6$ hydroxyalkyl, benzyl, and mixtures thereof; $R^1$ is preferably $C_{11}$–$C_{22}$ linear alkyl, $C_{11}$–$C_{22}$ branched alkyl, and mixtures thereof; $R^1$ is preferably $C_{11}$–$C_{22}$ linear alkyl, $C_{11}$–$C_{22}$ branched alkyl, linear alkenyl, $C_{11}$–$C_{22}$ branched alkenyl, and mixtures thereof; Q is a carbonyl moiety independently selected from the units having the formula:

$$-O-\overset{O}{\overset{\|}{C}}-,\quad -\overset{O}{\overset{\|}{C}}-O-,\quad -\overset{R^2}{\overset{|}{N}}-\overset{O}{\overset{\|}{C}}-,$$

$$-\overset{O}{\overset{\|}{C}}-\overset{R^2}{\overset{|}{N}}-,\quad -O-\overset{O}{\overset{\|}{C}}-O-,$$

-continued

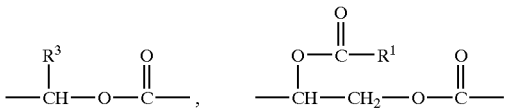

wherein $R^2$ is hydrogen, $C_1$–$C_4$ alkyl, preferably hydrogen; $R^3$ is $C_1$–$C_4$ alkyl, preferably hydrogen or methyl; preferably Q has the formula:

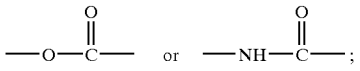

X is a softener compatible anion, preferably the anion of a strong acid, for example, chloride, bromide, methylsulfate, ethylsulfate, sulfate, nitrate and mixtures thereof, more preferably chloride and methyl sulfate. The anion can also, but less preferably, carry a double charge, in which case $X^{(-)}$ represents half a group. The index m has a value of from 1 to 3; the index n has a value of from 1 to 4, preferably 2 or 3, more preferably 2.

One embodiment of the present invention provides for amines and quaternized amines having two or more different values for the index n per molecule, for example, a softener active prepared from the starting amine methyl(3-aminopropyl)(2-hydroxyethyl)amine.

More preferred softener actives according to the present invention have the formula:

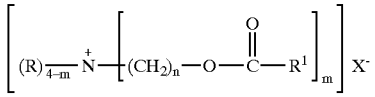

wherein the unit having the formula:

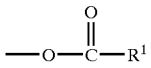

is a fatty acyl moiety. Suitable fatty acyl moieties for use in the softener actives of the present invention are derived from sources of triglycerides including tallow, vegetable oils and/or partially hydrogenated vegetable oils including inter alia canola oil, safflower oil, peanut oil, sunflower oil, corn oil, soybean oil, tall oil, rice bran oil. Yet more preferred are the Diester Quaternary Ammonium Compounds (DEQA's) wherein the index m is equal to 2.

The formulator, depending upon the desired physical and performance properties of the final fabric softener active, can choose any of the above mentioned sources of fatty acyl moieties, or alternatively, the formulator can mix sources of triglyceride to form a "customized blend". However, those skilled in the art of fats and oils recognize that the fatty acyl composition may vary, as in the case of vegetable oil, from crop to crop, or from variety of vegetable oil source to variety of vegetable oil source. DEQA's which are prepared using fatty acids derived from natural sources are preferred.

A preferred embodiment of the present invention provides softener actives comprising $R^1$ units which have at least about 3%, preferably at least about 5%, more preferably at least about 10%, most preferably at least about 15% $C_{11}$–$C_{22}$ alkenyl, including polyalkenyl (polyunsaturated) units inter alia oleic, linoleic, linolenic.

For the purposes of the present invention the term "mixed chain fatty acyl units" is defined as "a mixture of fatty acyl units comprising alkyl and alkenyl chains having from 10 carbons to 22 carbon atoms including the carbonyl carbon atom, and in the case of alkenyl chains, from one to three double bonds, preferably all double bonds in the cis configuration". With regard to the $R^1$ units of the present invention, it is preferred that at least a substantial percentage of the fatty acyl groups are unsaturated, e.g., from about 25%, preferably from about 50% to about 70%, preferably to about 65%. The total level of fabric softening active containing polyunsaturated fatty acyl groups can be from about 3%, preferably from about 5%, more preferably from about 10% to about 30%, preferably to about 25%, more preferably to about 18%. As stated herein above cis and trans isomers can be used, preferably with a cis/trans ratio is of from 1:1, preferably at least 3:1, and more preferably from about 4:1 to about 50:1, more preferably about 20:1, however, the minimum being 1:1.

The level of unsaturation contained within the tallow, canola, or other fatty acyl unit chain can be measured by the Iodine Value (IV) of the corresponding fatty acid, which in the present case should preferably be in the range of from 5 to 100 with two categories of compounds being distinguished, having a IV below or above 25.

Indeed, for compounds having the formula:

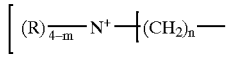

derived from tallow fatty acids, when the Iodine Value is from 5 to 25, preferably 15 to 20, it has been found that a cis/trans isomer weight ratio greater than about 30/70, preferably greater than about 50/50 and more preferably greater than about 70/30 provides optimal concentrability.

For compounds of this type made from tallow fatty acids having a Iodine Value of above 25, the ratio of cis to traits isomers has been found to be less critical unless very high concentrations are needed. A further preferred embodiment of the present invention comprises DEQA's wherein the average Iodine Value for $R^1$ is approximately 45.

The $R^1$ units suitable for use in the isotropic liquids present invention can be further characterized in that the Iodine Value (IV) of the parent fatty acid, said IV is preferably from about 10, more preferably from about 50, most preferably from about 70, to a value of about 140, preferably to about 130, more preferably to about 115. However, formulators, depending upon which embodiment of the present invention they choose to execute, may wish to add an amount of fatty acyl units which have Iodine Values outside the range listed herein above. For example, "hardened stock" (IV less than or equal to about 10) may be combined with the source of fatty acid admixture to adjust the properties of the final softener active.

A prefered source of fatty acyl units, especially fatty acyl units having branching, for example, "Guerbet branching", methyl, ethyl, etc. units substituted along the primary alkyl chain, synthetic sources of fatty acyl units are also suitable. For example, the formulator may with to add one or more fatty acyl units having a methyl branch at a "non-naturally occuring" position, for example, at the third carbon of a $C_{17}$ chain. What is meant herein by the tern "non-naturally occuring" is "acyl units whihc are not found in significant (greater than about 0.1%) quantities is common fats and oils which serve as feedstocks for the source of triglycerides described herein." If the desired branched chain fatty acyl unit is unavailable from readily available natural feedstocks, therefore, synthetic fatty acid can be suitably admixed with other synthetic materials or with other natural triglyceride derived sources of acyl units.

The following are examples of preferred softener actives according to the present invention.

N,N-di(tallowyl-oxy-ethyl)-N,N-dimethyl ammonium chloride;

N,N-di(canolyl-oxy-ethyl)-N,N-dimethyl ammonium chloride;

N,N-di(tallowyl-oxy-ethyl)-N-methyl, N-(2-hydroxyethyl) ammonium methyl sulfate;

N,N-di(canolyl-oxy-ethyl)-N-methyl, N-(2-hydroxyethyl) ammonium methyl sulfate;

N,N-di(tallowylamidoethyl)-N-methyl, N-(2-hydroxyethyl) ammonium methyl sulfate;

N,N-di(2-tallowyloxy-2-oxo-ethyl)-N,N-dimethyl ammonium chloride;

N,N-di(2-canolyloxy-2-oxo-ethyl)-N,N-dimethyl ammonium chloride;

N,N-di(2-tallowyloxyethylcarbonyloxyethyl)-N,N-dimethyl ammonium chloride;

N,N-di(2-canolyloxyethylcarbonyloxyethyl)-N,N-dimethyl ammonium chloride;

N-(2-tallowoyloxy-2-ethyl)-N2-tallowyloxy-2-oxo-ethyl)-N,N-dimethyl ammonium chloride;

N-(2-canolyloxy-2-ethyl)-N-(2-canolyloxy-2-oxo-ethyl)-N,N-dimethyl ammonium chloride;

N,N,N-tri(tallowyl-oxy-ethyl)-N-methyl ammonium chloride;

N,N,N-tri(canolyloxy-ethyl)-N-methyl ammonium chloride;

N-(2-tallowyloxy-2-oxoethyl)-N-(tallowyl)-N,N-dimethyl ammonium chloride;

N-(2-canolyloxy-2-oxoethyl)-N-(canolyl)-N,N-dimethyl ammonium chloride;

1,2-ditallowyloxy-3-N,N,N-trinethylammoniopropane chloride; and 1,2-dicanolyloxy-3-N,N,N-trimethylammoniopropane chloride;

and mixtures of the above actives.

Particularly preferred is N,N-di(tallowoyl-oxy-ethyl)-N,N-dimethyl ammonium chloride, where the tallow chains are at least partially unsaturated and N,N-di(canoloyl-oxy-ethyl)-N,N-dymethyl ammonium chloride, N,N-di(tallowyl-oxy-ethyl)-N-methyl, N-(2-hydroxyethyl) ammonium methyl sulfate; N,N-di(canolyl-oxy-ethyl)-N-methyl, N-(2-hydroxyethyl)ammonium methyl sulfate; and mixtures thereof.

Additional fabric softening agents useful herein are described in U.S. Pat. No. 5,643,865 Mermelstein et al., issued Jul. 1, 1997; U.S. Pat. No. 5,622,925 de Buzzaccarini et al., issued Apr. 22, 1997; U.S. Pat. No. 5,545,350 Baker et al., issued Aug. 13, 1996; U.S. Pat. No. 5,474,690 Wahl et al., issued Dec. 12, 1995; U.S. Pat. No. 5,417,868 Turner et al., issued Jan. 27, 1994; U.S. Pat. No. 4,661,269 Trinh et al., issued Apr. 28, 1987; U.S. Pat. No. 4,439,335 Burns, issued Mar. 27, 1984; U.S. Pat. No. 4,401,578 Verbruggen, issued Aug. 30, 1983; U.S. Pat. No. 4,308,151 Cambre, issued Dec. 29, 1981; U.S. 4,237,016 Rudkin et al., issued Oct. 27, 1978; U.S. Pat. No. 4,233,164 Davis, issued Nov. 11, 1980; U.S. Pat. No. 4,045,361 Watt et al., issued Aug. 30, 1977; U.S. Pat. No. 3,974,076 Wiersema et al., issued Aug. 10, 1976; U.S. Pat. No. 3,886,075 Bernadino, issued May 6, 1975; U.S. Pat. No. 3,861,870 Edwards et al., issued Jan. 21 1975; and European Patent Application publication No. 472,178, by Yamamura et al., all of said documents being incorporated herein by reference.

Principal Solvent

The compositions of the present invention, preferably the isotropic liquid embodiments thereof, may also optionally comprise a principal solvent. The level of principal solvent present in the compositions of the present invention is typically less than about 95%, preferably less than about 50%, more preferably less than about 25%, most preferably less than about 15% by weight. Some embodiments of isotropic liquid embodiments of the present invention may comprise no principal solvent but may substitute instead a suitable nonionic surfactant.

The principal solvents of the present invention are primarily used to obtain liquid compositions having sufficient clarity and viscosity. Principal solvents must also be selected to minmize solvent odor impact in the composition. For example, isopropyl alcohol is not an effective principal solvent in that it does not serve to produce a composition having suitable viscosity. Isopropanol also fails as a suitable principal solvent because it has a relatively strong odor.

Principal solvents are also selected for their ability to provide stable compositions at low temperatures, preferably compositions comprising suitable principal solvents are clear down to about 4° C. and have the ability to fully recover their clarity if stored as low as about 70° C.

The principal solvents according to the present invention are selected base upon their octanollwater partition coefficient (P). The octanol/water partition coefficient is a measure of the ratio of the concentrations of a particular principal solvent in octanol and water at equilibrium. The partition coefficients are conveniently expressed and reported as their logarithm to the base 10; logP.

The logP of many principal solvent species has been reported; for example, the Ponmona92 database, available from Daylight Chemical Information Systems, Inc.(Daylight CIS), contains many, along with citations to the original literature.

However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ransden, Eds., p. 295, Pergamon Press, 1990, incorporated herein by reference). The fragment approach is based on the chemical structure of each HR species, and takes into account the numbers and types of atoms, the atom connectivity, and chemical bonding. ClogP values are the most reliable and widely used estimates for octanol water partitioning. It will be understood by those skilled in the art that experimental log P values could also be used. Experimental log P values represent a less preferred embodiment of the invention. Where experimental log P values are used, the one hour log P values are preferred. Other methods that can be used to compute ClogP include, e.g., Crippen's fragmentation method as disclosed in *J. Chem. Inf. Comput. Sci.*, 27a,21 (1987); Viswanadhan's fragmentation method as disclosed in *J. Chem. Inf. Comput. Sci.*, 29, 163 (1989); and Broto's method as disclosed in *Eur. J. Med. Chem.—Chim. Theor.*, 19, 71 (1984).

The principal solvents suitable for use in the present invention are selected from those having a ClogP of from about 0.15 to about 1, preferably from about 0.15 to about 0.64, more preferably from about 0.25 to about 0.62, most preferably form about 0.4 to about 0.6. Preferably the principal solvent is at least to some degree an asymmetric molecule, preferably having a melting, or solidification point which allows the principal solvent to be liquid at or near room temperature. Low molecular weight principal solvents may be desirable for some embodiments. More preferred molecules are highly asymmetrical.

A further description of principal solvents suitable for use in the isotropic liquid compositions of the present invention are thoroughly described in WO 97/03169 "Concentrated, Stable Fabric Softening Composition", published Jan. 30, 1997 and assigned to the Procter & Gamble Co.; WO 97/03170 "Concentrated, Water Dispersible, Stable, Fabric Softening Composition", published Jan. 30, 1997 and assigned to the Procter & Gamble Co.; and WO 97/34972 "Fabric Softening Compound/Composition", published Sep. 25, 1997 and assigned to the Procter & Gamble Co. all included herein by reference.

Hydrophobic Dispersant

A preferred composition of the present invention comprises from about 0.1%, preferably from about 5%, more preferably form about 10% to about 80%, preferably to about 50%, more preferably to about 25% by weight, of a hydrophobic polyamine dispersant having the formula:

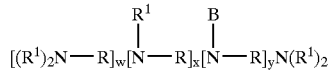

wherein R, $R^1$ and B are suitably described in U.S. Pat. No. 5,565,145 Watson et al., issued Oct. 15, 1996 incorporated herein by reference, and w, x, and y have values which provide for a backbone prior to substitution of preferably at least about 1200 daltons, more preferably 1800 daltons.

$R^1$ units are preferably alkyleneoxy units having the formula:

$$-(CH_2CHR'O)_m(CH_2CH_2O)_nH$$

wherein R' is methyl or ethyl, m and n are preferably from about 0 to about 50, provided the average value of alkoxylation provided by m+n is at least about 0.5.

A further description of polyamine dispersants suitable for use in the present invention is found in U.S. Pat. No. 4,891,160 Vander Meer, issued Jan. 2, 1990; U.S. Pat. No. 4,597,898, Vander Meer, issued Jul. 1, 1986; European Patent Application 111,965, Oh and Gosselink, published Jun. 27, 1984; European Patent Application 111,984, Gosselink, published Jun. 27, 1984; European Patent Application 112,592, Gosselink, published Jul. 4, 1984; U.S. Pat. No. 4,548,744, Connor, issued Oct. 22, 1985; and U.S. Pat. No. 5,565,145 Watson et al., issued Oct. 15, 1996; all of which are included herein by reference. However, any suitable clay/soil dispersent or anti-redepostion agent can be used in the laundry compositions of the present invention.

Electrolyte

The fabric softening emnbodiments of the compositions of the present invention, especially clear, isotropic liquid fabric softening compositions, may also optionally, but preferably comprise, one or more electrolytes for control of phase stability, viscosity, and/or clarity. For example, the presence of certain electrolytes inter alia calcium chloride, magnesium chloride may be key to insuring initial product clarity and low viscosity, or may affect the dilution viscosity of liquid embodiments, especially isotropic liquid embodiments. Not wishing to be limited by theory, but only wishing to provide an example of a circumstance wherein the formulator must insure proper dilution viscosity, includes the following example. Isotropic or non-isotropic liquid fabric softener compositions can be introduced into the rinse phase of laundry operations via an article of manufacture designed to dispense a measured amount of said composition. Typically the article of manufacture is a dispenser which delivers the softener active only during the rinse cycle. These dispensers are typically designed to allow an amount of water equal to the volume of softener composition to enter into the dispenser to insure complete delivery of the softener composition. An electrolyte may be added to the compositions of the present invention to insure phase stability and prevent the diluted softener composition from "gelling out" or from undergoing an undesirable or unacceptable viscosity increase. Prevention of gelling or formation of a "swelled", high viscosity solution insures thorough delivery of the softener composition.

However, those skilled in the art of fabric softener compositions will recognize that the level of electrolyte is also influenced by other factors inter alia the type of fabric softener active, the amount of principal solvent, and the level and type of nonionic surfactant. For example, triethanol amine derived ester quaternary amines suitable for use as softener actives according to the present invention are typically manufactured in such a way as to yield a distribution of mono-, di-, and tri-esterified quaternary ammonium compounds and amine precursors. Therefore, as in this example, the variability in the distribution of mono-, di-, and tri-esters and amines may predicate a different level of electrolyte. Therefore, the formulator must consider all of the ingredients, namely, softener active, nonionic surfactant, and in the case of isotropic liquids, the principal solvent type and level, as well as level and identity of adjunct ingredients before selecting the type andlor level of electrolyte.

A wide variety of ionizable salts can be used. Examples of suitable salts are the halides of the Group IA and IIA metals of the Periodic Table of the elements, e.g., calcium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 10,000 parts per million (ppm), preferably from about 20 to about 5,000 ppm, of the composition.

Alkylene polyammonium salts can be incorporated into the composition to give viscosity control in addition to or in place of the water-soluble, ionizable salts above, In addition, these agents can act as scavengers, forming ion pairs with anionic detergent carried over from the main wash, in the rinse, and on the fabrics, and can improve softness performance. These agents can stabilized the viscosity over a broader range of temperature, especially at low temperatures, compared to the inorganic electrolytes. Specific examples of alkylene polyammonium salts include L-lysine, monohydrochloride and 1,5-diammonium 2-methyl pentane dihydrochloride.

Cationic Charge Boosters

The compositions or the present invention may optionally comprise one or more cationic charge boosters, especially to the rinse-added fabric softening embodiments of the present invention. Typically, ethanol is used to prepare many of the below listed ingredients and is therefore a source of solvent into the final product formulation. The formulator is not limited to ethanol, but instead can add other solvents inter alia hexyleneglycol to aid in formulation of the final composition. This is especially true in clear, translucent, isotropic compositions.

The preferred cationic charge boosters of the present invention are described herein below.

i) Ouaternary Ammonium Compounds

An optional composition of the present invention comprises at least about 0.2%, preferably from about 0.2% to about 10%, more preferably from about 0.2% to about 5% by weight, of a cationic charge booster having the formula:

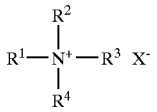

wherein $R^1$, $R^2$, $R^3$, and $R^4$ are each independently $C_1$–$C_{22}$ alkyl, $C_3$–$C_{22}$ alkenyl, $R^5$—Q—$(CH_2)_m$—, wherein $R^5$ is $C_1$–$C_{22}$ alkyl, and mixtures thereof, m is from 1 to about 6; X is an anion.

Preferably $R^1$ is $C_6$–$C_{22}$ alkyl, $C_6$–$C_{22}$ alkenyl, and mixtures thereof, more preferably $C_{11}$–$C_{18}$ alkyl, $C_{11}$–$C_{18}$ alkenyl, and mixtures thereof; $R^2$, $R^3$, and $R^4$ are each preferably $C_1$–$C_4$ alkyl, more preferably each $R^2$, $R^3$, and $R^4$ are methyl.

The formulator may similarly choose $R^1$ to be a $R^5$—Q $(CH_2)_m$— moiety wherein $R^5$ is an alkyl or alkenyl moiety having from 1 to 22 carbon atoms, preferably the alkyl or alkenyl moiety when taken together with the Q unit is an acyl unit derived preferably derived from a source of triglyceride selected from the group consisting of tallow, partially hydrogenated tallow, lard, partially hydrogenated lard, vegetable oils and/or partially hydrogenated vegetable oils, such as, canola oil, safflower oil, peanut oil, sunflower oil, corn oil, soybean oil, tall oil, rice bran oil, etc. and mixtures thereof.

An example of a fabric softener cationic booster comprising a $R^5$—$(CH_2)_m$— moiety has the formula:

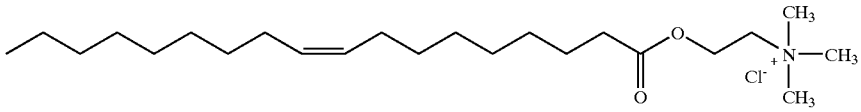

wherein $R^5$—Q— is an oleoyl units and m is equal to 2.

X is a softener compatible anion, preferably the anion of a strong acid, for example, chloride, bromide, methylsulfate, ethylsulfate, sulfate, nitrate and mixtures thereof, more preferably chloride and methyl sulfate.

ii) Polyvinyl Amines

A preferred embodiment of the present invention contains at least about 0.2%, preferably from about 0.2% to about 5%, more preferably from about 0.2% to about 2% by weight, of one or more polyvinyl amines having the formula

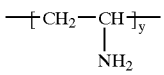

wherein y is from about 3 to about 10,000, preferably from about 10 to about 5,000, more preferably from about 20 to about 500. Polyvinyl amines suitable for use in the present invention are available from BASF.

Optionally, one or more of the polyvinyl amine backbone —$NH_2$ unit hydrogens can be substituted by an alkyleneoxy unit having the formula:

—$(R^1O)_xR^2$ wherein $R^1$ is $C_2$–$C_4$ alkylene, $R^2$ is hydrogen, $C_1$–$C_4$ alkyl, and mixtures thereof; x is from 1 to 50. In one embodiment or the present invention the polyvinyl amine is reacted first with a substrate which places a 2-propyleneoxy unit directly on the nitrogen followed by reaction of one or more moles of ethylene oxide to form a unit having the general formula:

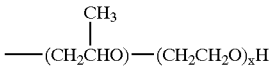

wherein x has the value of from 1 to about 50. Substitutions such as the above are represented by the abbreviated formula PO—$EO_x$—. However, more than one propyleneoxy unit can be incorporated into the alkyleneoxy substituent.

Polyvinyl amines are especially preferred for use as cationic charge booster in liquid fabric softening compositions since the greater number of amine moieties per unit weight provides substantial charge density. In addition, the cationic charge is generated in situ and the level of cationic charge can be adjusted by the formulator.

iii) Poly-Ouaternary Ammonium Compounds

A preferred composition of the present invention comprises at least about 0.2%, preferably from about 0.2% to about 10%, more preferably from about 0.2% to about 5% by weight, of a cationic charge booster having the formula:

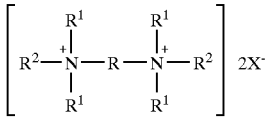

wherein R is substituted or unsubstituted $C_2$–$C_{12}$ alkylene, substituted or unsubstituted $C_2$–$C_{12}$ hydroxyalkylene; each $R^1$ is independently $C_1$–$C_4$ alkyl, each $R^2$ is independently $C_1$–$C_{22}$ alkyl, $C_3$–$C_{22}$ alkenyl, $R^5$—Q—$(CH_2)_m$—, wherein $R^5$ is $C_1$–$C_{22}$ alkyl, $C_3$–$C_{22}$ alkenyl, and mixtures thereof; m is from 1 to about 6; Q is a carbonyl unit as defined hereinabove; and mixtures thereof; X is an anion.

Preferably R is ethylene; $R^1$ is methyl or ethyl, more preferably methyl; at least one $R^2$ is preferably $C_1$–$C_4$ alkyl, more preferably methyl. Preferably at least one $R^2$ is $C_{11}$–$C_{22}$ alkyl, $C_{11}$–$C_{22}$ alkenyl, and mixtures thereof.

The formulator may similarly choose $R^2$ to be a $R^5$—Q—$CH_2)_m$— moiety wherein $R^5$ is an alkyl moiety having from 1 to 22 carbon atoms, preferably the alkyl moiety when taken together with the Q unit is an acyl unit derived preferably derived from a source of triglyceride selected from the group consisting of tallow, partially hydrogenated tallow, lard, partially hydrogenated lard, vegetable oils and/or partially hydrogenated vegetable oils, such as, canola oil, safflower oil, peanut oil, sunflower oil, corn oil, soybean oil, tall oil, rice bran oil, etc. and mixtures thereof.

An example of a fabric softener cationic booster comprising a $R^5$-Q-(CH2)$_m$— moiety has the formula:

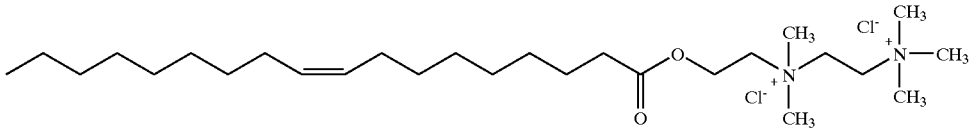

in $R^1$ is methyl, one $R^2$ units is methyl and the other $R^2$ unit is $R^5$—Q—$(CH_2)_m$— wherein $R^5$—Q—is an oleoyl unit and m is equal to 2.

X is a softener compatible anion, preferably the anion of a strong acid, for example, chloride, bromide, methylsulfate, ethylsulfate, sulfate, nitrate and mixtures thereof, more preferably chloride and methyl sulfate.

Dispersibility Aids

Relatively concentrated compositions containing both saturated and unsaturated diester quaternary ammonium compounds can be prepared that are stable without the addition of concentration aids. However, the compositions of the present invention may require organic and/or inorganic concentration aids to go to even higher concentrations and/or to meet higher stability standards depending on the other ingredients. These concentration aids which typically can be viscosity modifiers may be needed, or preferred, for ensuring stability under extreme conditions when particular softener active levels are used. The surfactant concentration aids are typically selected from the group consisting of (1) single long chain alkyl cationic surfactants; (2) nonionic surfactants; (3) amine oxides; (4) fatty acids; and (5) mixtures thereof. These aids are described in P&G Copending application Ser. No. 08/461,207, filed Jun. 5, 1995, Wahl et al., specifically on page 14, line 12 to page 20, line 12, which is herein incorporated by reference.

Preferred dispersibility aids are GENAMINE® and GENAPOL® ex Clariant. When PVP is present in the compositions of the present invention, a preferred embodiment comprises both a cocoyl ethoxylated amine and a cocoyl ethoxylated alcohol, wherein the ethoxylation is approximately 10, each of which are available as GENAMINE® and GENAPOL®. A preferred example of the use of this admixture is a composition which comprises, for example, 0.2% GENAMINE® and 0.1% GENAPOL®.

When said dispersibility aids are present, the total level is from 0.1%, preferably from 0.3%, more preferably from 3%, even more preferably from 4%, and most preferably from 5% to 25%, preferably to 17%, more preferably to 15%, most preferably to 13% by weight, of the composition. These materials can either be added as part of the active softener raw material, e.g., the mono-long chain alkyl cationic surfactant and/or the fatty acid which are reactants used to form the fabric softener active as discussed hereinbefore, or added as a separate component. The total level of dispersibility aid includes any amount that may be present as part of the softener active.

Soil Release Agents

Particular to the embodiments of the rinse-added fabric softeners according to the present invention, certain soil release agents provide not only the below described soil release properties but are added for their suitability in maintaining proper viscosity, especially in the dispersed phase, non-isotropic compositions.

Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of the rinsing cycle and, thus, serve as an anchor for the hydrophilic segments. This can enable stains occurring subsequent to treatment with the soil release agent to be more easily cleaned in later washing procedures.

If utilized, soil release agents will generally comprise from about 0.01% to about 10.0%, by weight, of the detergent compositions herein, typically from about 0.1% to about 5%, preferably from about 0.2% to about 3.0%.

The following, all included herein by reference, describe soil release polymers suitable for us in the present invention. U.S. Pat. No. 5,728,671 Rohrbaugh et al., issued Mar. 17, 1998; U.S. Pat. No. 5,691,298 Gosselink et al., issued Nov. 25, 1997; U.S. Pat. No. 5,599,782 Pan et al., issued Feb. 4, 1997; U.S. Pat. No. 5,415,807 Gosselink et al., issued May 16, 1995; U.S. Pat. No. 5,182,043 Morrall et al., issued Jan. 26, 1993; U.S. Pat. No. 4,956,447 Gosselink et al., issued Sep. 11, 1990; U.S. Pat. No. 4,976,879 Maldonado et al. issued Dec. 11, 1990; U.S. Pat. No. 4,968,451 Scheibel et al., issued Nov. 6, 1990; U.S. Pat. No. 4,925,577 Borcher, Sr. et al., issued May 15, 1990; U.S. Pat. No. 4,861,512 Gosselink, issued Aug. 29, 1989; U.S. Pat. No. 4,877,896 Maldonado et al., issued Oct. 31, 1989; U.S. Pat. No. 4,721,580 Gosselink issued Jan. 26, 1988; U.S. Pat. No. 4,702,857 Gosselink, issued Oct. 27, 1987; U.S. Pat. No. 4,711,730 Gosselink et al., issued Dec. 8, 1987; U.S. Pat. No. 4,000,093 Nicol et al., issued Dec. 28, 1976; U.S. Pat. No. 3,959,230 Hayes, issued May 25, 1976; U.S. Pat. No. 3,893,929 Basadur, issued July 8, 1975; and European Patent Application 0 219 048, published Apr. 22, 1987 by Kud et al.

Further suitable soil release agents are described in U.S. Pat. No. 4,201,824 Voilland et al.; U.S. Pat. No. 4,240,918 Lagasse et al.; U.S. Pat. No. 4,525,524 Tung et al.; U.S. Pat. No. 4,579,681 Ruppert et al.; U.S. Pat. No. 4,220,918; U.S. Pat. No. 4,787,989; EP 279,134 A, 1988 to Rhone-Poulenc Chemie; EP 457,205 A to BASF (1991); and DE 2,335,044 to Unilever N. V., 1974; all incorporated herein by reference.

Bleach Protection Polyamines

The compositions of the present invention optionally comprise from about 0.01%, preferably from about 0.75%, more preferably from 10%, most preferably from about 15% to about 50%, preferably to about 35%, more preferably to about 30%, most preferably to about 5% by weight, of one or more linear or cyclic polyamines which provide bleach protection.

Linear Polyamines

The bleach protection polyamines of the present invention have the formula:

$$(R^1)_2N-R-[\overset{\overset{\displaystyle R^2}{|}}{N}-R]_n-N(R^1)_2$$

wherein R is 1,2-propylene, 1,3-propylene, and mixtures thereof; preferably 1,3-propylene. $R^1$ is hydrogen, $C_1$–$C_4$ alkyl, or an alkyleneoxy unit having the formula:

$$-(R^3O)-R^4$$

wherein $R^3$ is ethylene, 1,2-propylene, 1,2-butylene, or mixtures thereof; preferably $R^3$ is ethylene or 1,2-propylene, more preferably 1,2-propylene. $R^4$ is hydrogen, $C_1$–$C_4$ alkyl, and mixtures thereof; preferably hydrogen. $R^1$ may comprise any mixture of alkyleneoxy units. $R^2$ is hydrogen, $R^1$, —$RN(R^1)_2$, and mixtures thereof; preferably at least one $R^2$ is hydrogen when n is equal to 2. The integer n is 1 or 2.

A prefered bleach protection linear polyamine has a backbone wherein R is 1,3-propylene, $R^2$ is hydrogen, or alkoxy, and n is equal to 2 is N,N'-bis(3-aminopropyl)-1,3-propylenediamine (TPTA).

Cyclic Amines

The bleach protection cyclic polyamines of the present invention comprise polyamine backbones having the formula:

R—L—R wherein L is a linking unit, said linking unit comprising a ring having at least 2 nitrogen atoms; R is hydrogen, —$(CH_2)_kN(R^1)_2$, and mixtures thereof; wherein each index k independently has the value from 2 to 4, preferably 3. Preferably the backbone of the cyclic amines including R units is 200 daltons or less.

$R^1$ is hydrogen or an alkyleneoxy unit having the formula:

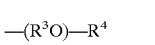

—$(R^3O)$—$R^4$ wherein $R^3$ is ethylene, 1,2-propylene, 1,2-butylene, or mixtures thereof; preferably $R_3$ is ethylene or 1,2-propylene, more preferably 1,2-propylene. $R^1$ is hydrogen, $C_1$–$C_4$ alkyl, and mixtures thereof; preferably hydrogen. $R^1$ may comprise any mixture of alkyleneoxy units.

Examples of preferred optional polyamines of the present invention have the formula:

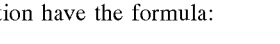

$(R^1)_2N$—$(CH_2)_k$—L—$(CH_2)_k$—$N(R^1)_2$ wherein the indices k each have the same value and each $R^1$ is the same unit.

It has been surprisingly found that bleach protection is enhanced when the backbone nitrogens are substituted with one or more modifications which comprise an alkyleneoxy unit having the general formula:

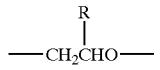

—$CH_2CH(R)O$— wherein said unit is $R^3$ as defined herein above.

METHOD OF USE

The present invention also relates to a method for enhancing the fabric integrity inter alia dye fidelity while reducing the damage to fabric due to the interaction of laundry adjunct ingredients and damage due to mechanical wear. The method includes the step of contacting fabric with an aqueous solution containing a least 50 ppm, preferably at least about 100 ppm. more preferably at least about 200 ppm. said composition comprising A) from about 0.1%, preferably from about 1%, more preferably from 2.5% to about 30%, preferably to about 20%, more preferably to about 10% by weight, of a polymeric material selected from the group consisting of:
   a) homo-condensates of basic amino acid, said amino acids selected from the group consisting of lysine, ornithine, arginine, and tryptophan;
   b) co-condensates of basic amino acids, said amino acids selected from the group consisting of lysine, ornithine, arginine, and tryptophan;
   c) co-polymers produced from the reaction of one or more basic amino acids with one or more co-condensable compounds;
   d) co-polymers produced from the reaction of one or more homo-condensates from (a) or co-condensates from (b) with one or more co-condensable compounds;
   e) crosslinked basic amino acid-containing polymers, said crosslinked polymers comprising:
      i) one or more basic amino acids;
      ii) co-polymers of (i) and one or more co-condensable compounds;
      iii) optionally co-polymers produced from the reaction of one or more homo-condensates from (a) or co-condensates from (b) with one or more co-condensable compounds; and
      iv) one or more crosslinking unit; wherein at least one crosslinking unit is derived from a crosslinker which comprises at least two functional groups;
   f) co-condensates formed from the reaction of one or more compounds selected from the group consisting of:
      i) basic amino acids;
      ii) co-condensable compounds;
      iii) crosslinking agents:
   g) optionally said homo-condensates from (a), co-condensates from (b), co-polymers from (c) and (d), crosslinked polymers from (e), and co-condensates from (t), are alkoxylated with from an average of 0.1 to about 30 alkyleneoxy units; and
   h) mixtures thereof;

B) the balance carriers and adjunct ingredients.

For the purposes of the present invention the term "contacting" is defined as "intimate contact of a fabric with an aqueous solution of the hereinabove described composition which comprises a fabric abrasion reducing polymer." Contacting typically occurs by soaking, washing, rinsing, spraying the composition onto fabric, but can also include contact of a substrate inter alia a material onto which the composition has been absorbed, with the fabric. Laundering is a preferred process, for example during the wash cycle, preferably during the rinse cycle. Temperatures for laundering can take place at a variety of temperatures, however, laundering typically occurs at a temperature less than about 30° C., preferably from about 5° C. to about 25° C.

A preferred method of the present invention comprises contacting fabric with a composition which comprises:

A) from about 1% to about 30% by weight, of a polymeric material selected from the group consisting of:
   a) homo-condensates of basic amino acid, said amino acids selected from the group consisting of lysine, ornithine, arginine, and tryptophan;
   b) co-condensates of basic amino acids, said amino acids selected from the group consisting of lysine, ornithine, arginine, and tryptophan;
   c) co-polymers produced from the reaction of one or more basic amino acids with one or more co-condensable compounds;
   d) co-polymers produced from the reaction of one or more homo-condensates from (a) or co-condensates from (b) with one or more co-condensable compounds;
   e) crosslinked basic amino acid-containing, polymers, said crosslinked polymers comprising;
      i) one or more basic amino acids;
      ii) co-polymers of (i) and one or more co-condensable compounds;- iii) optionally co-polymers produced from the reaction of one or more homo-condensates from (a) or co-condensates from (b) with one or more co-condensable compounds: and iv) one or more crosslinking unit;

wherein at least one crosslinking unit is derived from a crosslinker which comprises at least two functional groups;

f) co-condensates formed from the reaction of one or more compounds selected from the group consisting of:

i) basic amino acids;

ii) co-condensable compounds;

iii) crosslinkiing agents;

g) optionally said homo-condensates from (a), co-condensates from (b), co-polymers from (c) and (d), crosslinked polymers from (e), and co-condensates from (f), are alkoxylated with from an average of 0.1 to about 30 alkyleneoxy units; and h) mixtures thereof:

B) from about 1%, preferably from about 10%, more preferably from about 20% to about 80%, preferably to about 60%, more preferably to about 45% by weight, of a fabric softening active; and C) the balance carrier and adjunct ingredients.

The following are non-limiting examples of compositions which illustrate the present invention.

TABLE I

| Ingredients | Weight % | | | |
|---|---|---|---|---|
| | 8 | 9 | 10 | 11 |
| DEQA[1] | 26.0 | 25.7 | 26.0 | 30.0 |
| Lysine/polymeric material[2] | 0.5 | 1.0 | — | — |
| Lysine/polymeric material[3] | — | — | 2.0 | — |
| Lysine/polymeric material[4] | — | — | — | 5.0 |
| Polypropyleneimine[5] | 2.0 | — | — | — |
| Polypropyleneimine[6] | — | 1.0 | — | — |
| Polypropyleneimine[7] | — | — | 2.0 | 2.4 |
| Ethanol | 2.2 | 2.4 | 2.2 | 2.6 |
| Hexylene glycol | 2.6 | 2.3 | 2.6 | 2.6 |
| 1,2-Hexanediol | 17.0 | — | 17.0 | — |
| TMPD[8] | — | 11.9 | — | 12.0 |
| CHDM[9] | — | 5.0 | — | 48.1 |
| Water | 52.5 | 53.6 | 52.5 | 48.1 |
| Minors[10] | balance | balance | balance | balance |

[1]N,N-di(canoyloxyethyl)-N-2-hydroxyethyl-N-methyl ammonium methyl sulfate available from Witco.
[2]Polyamino acid polymer formed from L-lysine and ϵ-caprolactam (1:1).
[3]Polyamino acid polymer formed from L-lysine, ϵ-caprolactam, lauric acid (5:5:1).
[4]Polyamino acid polymer formed from L-lysine, and lauric acid (5:1).
[5]N,N'-(3-aminopropyl)ethylenediamine.
[6]N,N'-(3-aminopropyl)butylenediamine.
[7]Tripropylenetetraamine.
[8]Trimethyl pentanediol available from Eastman Chemical.
[9]1,4-cyclohexane dimethanol available from Eastman Chemical.
[10]Minors can include perfume, dye, acid, preservatives, etc.

TABLE II

| Ingredients | Weight % | | | |
|---|---|---|---|---|
| | 12 | 13 | 14 | 15 |
| DEQA[1] | 26.0 | 25.7 | 26.0 | 30.0 |
| Lysine/polymeric material[2] | 0.5 | 1.0 | — | — |
| Lysine/polymeric material[3] | — | — | 2.0 | — |
| Lysine/polymeric material[4] | — | — | — | 5.0 |
| Ethanol | 2.2 | 2.4 | 2.2 | 2.6 |
| Hexylene glycol | 2.6 | 2.3 | 2.6 | 2.6 |
| 1,2-Hexanediol | 17.0 | — | 17.0 | — |
| TMPD[5] | — | 11.9 | — | 12.0 |

TABLE II-continued

| Ingredients | Weight % | | | |
|---|---|---|---|---|
| | 12 | 13 | 14 | 15 |
| CHDM[6] | — | 5.0 | — | 48.1 |
| Water | 52.5 | 53.6 | 52.5 | 48.1 |
| Minors[7] | balance | balance | balance | balance |

[1]N,N-di(canoyloxyethyl)-N-2-hydroxyethyl-N-methyl ammonium methyl sulfate available from Witco.
[2]Polyamino acid polymer formed from L-lysine and ϵ-caprolactam (1:1).
[3]Polyamino acid polymer formed from L-lysine, ϵ-caprolactam, lauric acid (5:5:1).
[4]Polyamino acid polymer formed from L-lysine, and lauric acid (5:1).
[5]Trimethyl pentanediol available from Eastman Chemical.
[6]1,4-cyclohexane dimethanol available from Eastman Chemical.
[7]Minors can include perfume, dye, acid, preservatives, etc.

TABLE III

| Ingredients | Weight % | | | |
|---|---|---|---|---|
| | 16 | 17 | 18 | 19 |
| Lysine/polymeric material[1] | 10.0 | — | — | 2.5 |
| Lysine/polymeric material[2] | — | 5.0 | — | — |
| Lysine/polymeric material[3] | — | — | 7.5 | — |
| Polyamine[4] | 17.5 | 10.0 | — | 17.5 |
| Dye fixative[5] | 2.4 | 2.4 | 3.0 | 2.4 |
| Anti-scaling agent[6] | 1.0 | 1.0 | 0.5 | 1.0 |
| Ammonium chloride | — | 0.2 | 0.2 | — |
| Polyamine[7] | — | — | — | 3.5 |
| Water/Minors[8] | balance | balance | balance | balance |

[1]Polyamino acid polymer formed from L-lysine and ϵ-caprolactam (1:1).
[2]Polyamino acid polymer formed from L-lysine, ϵ-caprolactam, lauric acid (5:5:1).
[3]Polyamino acid polymer formed from L-lysine, and lauric acid (5:1).
[4]N,N'-bis(3-aminopropyl)-1,4-piperazine.
[5]Cartafix CB.
[6]Bayhibit AM.
[7]Luviskol K90 ex BASF.
[8]Minors can include perfume, dye, acid, preservatives, etc.

TABLE IV

| Ingredients | Weight % | | | |
|---|---|---|---|---|
| | 20 | 21 | 22 | 23 |
| Lysine/polymeric material[1] | 10.0 | — | — | 2.5 |
| Lysine/polymeric material[2] | — | 5.0 | — | — |
| Lysine/polymeric material[3] | — | — | 7.5 | — |
| Polyamine[4] | 17.5 | 10.0 | — | 17.5 |
| Dye fixative[5] | 2.4 | 2.4 | 3.0 | 2.4 |
| Anti-scaling agent[6] | 1.0 | 1.0 | 0.5 | 1.0 |
| Ammonium chloride | — | 0.2 | 0.2 | — |
| Polyamine[7] | — | — | — | 3.5 |
| Water/Minors[8] | balance | balance | balance | balance |

[1]Polyamino acid polymer formed from L-lysine which is subsequently alkoxylated with ethylene oxide to an average EO of 1.
[2]Polyamino acid polymer formed from L-lysine, ϵ-caprolactam, lauric acid (5:5:1) which is subsequently alkoxylated with ethylene oxide to an average EO of 1.
[3]Polyamino acid polymer formed from L-lysine, and lauric acid (5:1) which is subsequently alkoxylated with ethylene oxide to an average EO of 1.
[4]N,N'-bis(3-aminopropyl)-1,4-piperazine.
[5]Cartafix CB.
[6]Bayhibit AM.
[7]Luviskol K90 ex BASF.
[8]Minors can include perfume, dye, acid, preservatives, etc.

TABLE V

| Ingredients | Weight % | | | |
|---|---|---|---|---|
| | 24 | 25 | 26 | 27 |
| Lysine/polymeric material[1] | 17.5 | — | — | 18.0 |
| Lysine/polymeric material[2] | — | 17.0 | — | — |
| Lysine/polymeric material[3] | — | — | 17.5 | — |
| Dye fixative[4] | 2.4 | 2.4 | 3.0 | 2.4 |
| Anti-scaling agent[5] | 1.0 | 1.0 | 0.5 | 1.0 |
| Ammonium chloride | — | 0.2 | 0.2 | — |
| Polyamine[6] | — | — | — | 3.5 |
| Water/Minors[7] | balance | balance | balance | balance |

[1]Polyamino acid polymer formed from L-lysine and ϵ-caprolactam (1:1) which is subsequently alkoxylated with ethylene oxide to an average EO of 1.

[2]Polyamino acid polymer formed from L-lysine, ϵ-caprolactam, lauric acid (5:5:1) which is subsequently alkoxylated with ethylene oxide to an average EO of 1.

[3]Polyamino acid polymer formed from L-lysine which is subsequently alkoxylated with ethylene oxide to an average EO of 1.

[4]Cartafix CB.

[5]Bayhibit AM.

[6]Luviskol K90 ex BASF.

[7]Minors can include perfume, dye, acid, preservatives, etc.

TABLE VI

| Ingredients | Weight % | | | |
|---|---|---|---|---|
| | 28 | 29 | 30 | 31 |
| Lysine/polymeric material[1] | 10 | 8.5 | — | — |
| Lysine/polymeric material[2] | — | — | 5.0 | — |
| Lysine/polymeric material[3] | — | — | — | 5.0 |
| Ethanol | 2.2 | 2.4 | 2.2 | 2.6 |
| Hexylene glycol | 2.6 | 2.3 | 2.6 | 2.6 |
| 1,2-Hexanediol | 17.0 | — | 17.0 | — |
| TMPD[4] | — | 11.9 | — | 12.0 |
| CHDM[5] | — | 5.0 | — | 48.1 |
| Water | 52.5 | 53.6 | 52.5 | 48.1 |
| Minors[6] | balance | balance | balance | balance |

[1]Polyamino acid polymer formed from L-lysine and ϵ-caprolactam (1:1).
[2]Polyamino acid polymer formed from L-lysine, ϵ-caprolactam, lauric acid (5:5:1).
[3]Polyamino acid polymer formed from L-lysine, and lauric acid (5:1).
[4]Trimethyl pentanediol available from Eastman Chemical.
[5]1,4-cyclohexane dimethanol available from Eastman Chemical.
[6]Minors can include perfume, dye, acid, preservatives, etc.

TABLE VII

| Ingredients | weight % | | | | |
|---|---|---|---|---|---|
| | 32 | 33 | 34 | 35 | 36 |
| Softener Active[1] | 28.0 | 30.0 | 30.0 | 30.0 | 30.0 |
| Lysine/polymeric material[2] | 2.0 | 2.3 | 2.0 | 2.0 | 3.0 |
| Ethanol | 2.4 | 2.3 | 2.6 | 2.6 | 2.6 |
| Hexyleneglycol | 2.3 | 2.7 | 2.3 | 2.3 | 2.3 |
| 2,2,4-Trimethyl-1,3-pentanediol | 4.0 | — | 5.0 | 9.0 | 9.0 |
| 2-Ethyl-1,3-hexandiol | 4.0 | — | — | — | — |
| Polyoxyalkylene alkylamide[3] | 1.5 | 1.5 | 1.5 | 1.5 | — |

TABLE VII-continued

| Ingredients | weight % | | | | |
|---|---|---|---|---|---|
| | 32 | 33 | 34 | 35 | 36 |
| Polyoxyalkylene alkylamide[4] | — | — | — | — | 1.5 |
| $CaCl_2$ | 0.05 | 0.5 | 0.125 | 0.125 | 0.125 |
| Perfume | 2.5 | 1.0 | 2.5 | 2.5 | 2.5 |
| Demineralized water | balance | balance | balance | balance | balance |

[1]N,N-di-(canolyl-oxy-ethyl)-N-methyl-N-(2-hydroxyethyl) ammonium methyl sulfate.

[2]Polyamino acid polymer formed from L-lysine and ϵ-caprolactam (1:1).

[3]PEG-6 cocamide, (Rewopal C6 ex Witco Chemical).

[4]PEG-5 lauramide (Amidox L-5, ex Stepan Chemical).

TABLE VIII

| Ingredients | weight % | | | | |
|---|---|---|---|---|---|
| | 37 | 38 | 39 | 40 | 41 |
| Softener Active[1] | 28.0 | 30.0 | 30.0 | 30.0 | 30.0 |
| Lysine/polymeric material[2] | 0.5 | 0.75 | 1.7 | 3.0 | 2.0 |
| Polypropyleneimine[3] | 2.0 | 2.3 | 2.0 | — | — |
| Ethanol | 2.4 | 2.3 | 2.6 | 2.6 | 2.6 |
| Hexyleneglycol | 2.3 | 2.7 | 2.3 | 2.3 | 2.3 |
| 2,2,4-Trimethyl-1,3-pentanediol | 4.0 | — | 5.0 | 9.0 | 9.0 |
| 2-Ethyl-1,3-hexandiol | 4.0 | — | — | — | — |
| Polyoxyalkylene alkylamide[3] | 1.5 | 1.5 | 1.5 | 1.5 | — |
| Polyoxyalkylene alkylamide[4] | — | — | — | — | 1.5 |
| $CaCl_2$ | 0.05 | 0.5 | 0.125 | 0.125 | 0.125 |
| Perfume | 2.5 | 1.0 | 2.5 | 2.5 | 2.5 |
| Demineralized water | balance | balance | balance | balance | balance |

[1]N,N-di-(canolyl-oxy-ethyl)-N-methyl-N-(2-hydroxyethyl) ammonium methyl sulfate.

[2]Polyamino acid polymer formed from L-lysine and amino caproic acid (1:1).

[3]PEG-6 cocamide, (Rewopal C6 ex Witco Chemical).

[4]PEG-5 lauramide (Amidox L-5, ex Stepan Chemical).

TABLE IX

| Ingredients | weight % | | | | |
|---|---|---|---|---|---|
| | 42 | 43 | 44 | 45 | 46 |
| Softener Active[1] | 30.0 | 30.0 | 35.0 | 23.4 | 36.0 |
| Lysine/polymeric material[2] | 2.0 | 2.3 | 2.0 | 2.0 | 3.0 |
| Ethanol | 2.6 | 3.4 | 2.5 | 2.0 | 3.1 |
| Hexyleneglycol | 2.3 | 2.3 | 2.5 | — | 6.2 |
| 2,2,4-Trimethyl-1,3-pentanediol | 9.0 | 9.0 | 4.0 | — | — |

TABLE IX-continued

| Ingredients | weight % | | | | |
|---|---|---|---|---|---|
| | 42 | 43 | 44 | 45 | 46 |
| 2-Ethyl-1,3-hexandiol | — | — | 4.0 | — | — |
| Polyoxyalkylene alkylamide[3] | — | 1.5 | 3.0 | 2.1 | 1.8 |
| Polyoxyalkylene alkylamide[4] | 1.5 | | — | — | — |
| Monocanola trimethylammonium chloride[5] | — | 1.5 | — | — | — |
| $CaCl_2$ | 0.125 | 0.125 | 0.125 | 0.33 | 0.125 |
| Perfume | 2.5 | 2.5 | 2.5 | 2.1 | 1.2 |
| Demineralized water | balance | balance | balance | balance | balance |

[1]N,N-di-(canolyl-oxy-ethyl)-N-methyl-N-(2-hydroxyethyl) ammonium methyl sulfate.

[2]Polyamino acid polymer formed from L-lysine and amino caproic acid (1:1).

[3]PEG-6 cocamide, (Rewopal C6 ex Witco Chemical).

[4]PEG-7 oleamide (Ethomid 0/17, ex Akzo Chemical).

[5]Adogen 417, ex Witco Chemical.

TABLE X

| Ingredients | weight % | | | | | |
|---|---|---|---|---|---|---|
| | 47 | 48 | 49 | 50 | 51 | 52 |
| Softener active[1] | 24.0 | — | — | — | — | 25.0 |
| Softener active[2] | — | — | 19.2 | — | — | — |
| Softener active[3] | — | — | — | — | 18.0 | — |
| Softener active[4] | — | 11.0 | — | 4.0 | — | — |
| Softener active[5] | — | 13.5 | — | — | — | — |
| Softener active[6] | — | | — | 3.4 | — | — |
| Lysine/polymeric material[7] | 0.5 | — | — | — | — | — |
| Lysine/polymeric material[8] | — | 0.5 | 1.0 | 2.0 | — | — |
| Lysine/polymeric material[9] | — | 0.5 | — | — | 2.0 | 3.0 |
| Ethanol | 4.0 | 5.0 | — | 1.0 | — | 4.0 |
| Isopropanol | — | — | 3.0 | — | 6.0 | — |
| Color care agent[10] | 2.5 | 3.0 | 3.0 | 3.0 | 4.0 | — |
| Calcium chloride | 2.0 | 0.5 | 0.2 | 0.05 | 0.5 | 0.6 |
| Hydrochloric acid | 0.75 | — | 0.06 | 0.2 | 0.02 | 0.05 |
| Soil release agent[11] | 0.5 | — | 0.2 | — | — | 0.5 |
| Polyamine[12] | 1.0 | 1.0 | — | — | — | — |
| Polyamine[13] | — | — | 1.0 | — | — | — |
| Polyamine[14] | — | — | — | — | 1.0 | — |
| Polyamine[15] | — | — | — | — | — | 1.0 |

TABLE X-continued

| Ingredients | weight % | | | | | |
|---|---|---|---|---|---|---|
| | 47 | 48 | 49 | 50 | 51 | 52 |
| Polyamine[16] | | | | 1.0 | | |
| Silicone anti-foam | 0.01 | — | 0.01 | 0.01 | — | 0.01 |
| Miscellaneous | 1.4 | 1.0 | 0.7 | 0.4 | 1.0 | 1.3 |
| Water | balance | balance | balance | balance | balance | balance |

[1]N,N-di(tallowyl-oxy-ethyl)-N,N-dimethyl ammonium chloride (tallowyl having an I.V. of 50).

[2]N,N-di(tallowyl-oxy-ethyl)-N,N-dimethyl ammonium chloride (tallowyl having an I.V. of 18).

[3]1,2-Ditallowyloxy-3-N,N,N-trimethylammoniopropane chloride.

[4]Ditallow dimethyl ammonium chloride.

[5]Methyl bis(tallow amidoethyl)-2-hydroxyethyl ammonium methyl sulfate.

[6]1-Tallowamidoethyl-2-imidazoline.

[7]Polyamino acid polymer formed from L-lysine and ϵ-caprolactam (1:1).

[8]Polyamino acid polymer formed from L-lysine, ϵ-caprolactam, lauric acid (5:5:1).

[9]Polyamino acid polymer formed from L-lysine, and lauric acid (5:1).

[10]N,N,N',N'-terakis(2-hydroxypropyl)ethylenediamine.

[11]Dimethyl terephthalate, 1,2-propylene glycol, methyl capped PEG polymer.

[12]N,N'-bis(3-aminopropyl)-1,3-propylenediamine.

[13]N,N'-bis(3-aminopropyl)-1,3-propylenediamine wherein each N—H unit is replaced by a 1,2-propyleneoxy unit.

[14]Pentrol ® available ex

[15]Bis(hexamethylene)triamine wherein each N—H unit is replaced by an ethyleneoxy unit.

[16]N,N'-bis(2-hydroxybutyl)-N,N'-bis[3-N,N-bis(2-hydroxybutyl) aminopropyl]-1,3-propylenediamine, which is N,N'-bis(3-aminopropyl)-1,3-propylenediamine wherein each hydrogen of the backbone is replaced by a 2-hydroxybutyl moiety.

The following are examples of compositions which prevent the fading of dye from fabric, especially cotton fabric.

TABLE XI

| Ingredients | weight % | | | | |
|---|---|---|---|---|---|
| | 53 | 54 | 55 | 56 | 57 |
| Softener Active[1] | 10.00 | 15.00 | — | 28.00 | — |
| Cationic dye fixative[2] | — | 3.00 | — | — | — |
| Hydrophobic dispersant[3] | 25.00 | 10.00 | 15.00 | — | — |
| Hydrophobic dispersant[4] | — | — | — | 10.00 | — |
| Hydrophobic dispersant[5] | — | — | — | — | 50.00 |
| Anti-scaling agent[6] | 1.00 | — | — | 1.00 | — |
| Anti-scaling agent[7] | — | — | — | — | 2.00 |
| Enzyme[8] | — | 0.50 | — | — | — |
| Polyamine[9] | 10.00 | 20.00 | 5.00 | | — |
| Polyamine[10] | — | — | — | 15.00 | — |
| Polyamine[11] | — | — | — | — | 10.00 |
| Lysine/polymeric material[12] | 0.5 | 0.5 | 0.5 | 0.5 | 0.5 |
| Perfume | 0.15 | 0.40 | 0.10 | 0.15 | 0.15 |
| Minors | balance | balance | balance | balance | balance |

[1]N,N-di-(canolyl-oxy-ethyl)-N-methyl-N-(2-hydroxyethyl) ammonium methyl sulfate.

[2]Selected from REWIN SRF, REWIN SRF-O and REWIN DWR ex CHT-Beitlich GMBH.

[3]Polyalkyleneimine having a molecular weight of 1800 and an average ethoxylation per backbone nitrogen of approximately 4.

[4]Polyalkyleneimine having a molecular weight of 1800 and an average ethoxylation per backbone nitrogen of approximately 1.

[5]Polyalkyleneimine having a molecular weight of 1800 and an average ethoxylation per backbone nitrogen of approximately 7.

[6]Hydroxyethanediphosphonate (HEDP).

[7]BAYHIBIT AM ex Baeyer.

[8]Suitable enzymes include cellulase, lipase, protease, peroxidase, and mixtures thereof.

[9]N,N'-bis(propyleneamino)-1,4-piperazine.

[10]N,N'-bis(propyleneamino)-1,4-piperazine E1.

[11]N,N'-bis(propyleneamino)-1,4-piperazine P1.

[12]Polyamino acid polymer formed from L-lysine and ϵ-caprolactam (1:1).

What is claimed is:

1. A fabric enhancement composition comprising:

A) from about 0.1% to about 30% by weight, of a polymeric material selected from the group consisting of:

a) homo-condensates of basic amino acid, said amino acids selected from the group consisting of lysine, ornithine, arginine, and tryptophan;

b) co-condensates of basic amino acids, said amino acids selected from the group consisting of lysine, ornithine, arginine, and tryptophan;

c) co-polymers produced from the reaction of one or more basic amino acids selected from the group consisting of lysine, ornithine, arginine, and tryptophan with one or more co-condensable compounds;

d) co-polymers produced from the reaction of one or more homo-condensable from (a) or co-condensates from (b) with one or more co-condensable compounds;

e) crosslinked basic amino acid-containing polymers, said crosslinked polymers comprising the reaction product of:

i) one or more basic amino acids, said amino acids selected from the group consisting of lysine, ornithine, arginine, and trytophan;

ii) co-polymers of (i) and one or more co-condensable compounds;

iii) optionally co-polymers produced from the reaction of one or more homo-condensates from (a) or co-condensates from (b) with one or more co-condensable compounds; and iv) one or more crosslinkng unit;

wherein at least one crosslinking unit is derived from a crosslinker which comprises at least two functional groups;

f) co-condensates formed from the reaction of:

i) basic amino acids, said amino acids selected from the group consisting of lysine, ornithine, arginine, and tryptophan;

ii) co-condensable compounds; and iii) crosslinking agents; and g) mixtures thereof;

wherein said homo-condensates from (a), co-condensates from (b), co-polymers from (c) and (d), crosslinked polymers from (e), and co-condensates from (f), are alkoxylated with from an average of 0.1 to about 30 alkyleneoxy units;

B) from about 1% to about 80% by weight, of a fabric softening active; and

C) the balance carriers and adjunct ingredients.

2. A composition according to claim 1 wherein said homo-condensate comprises lysine.

3. A composition according to claim 1 wherein said polymeric material is a co-polymer comprising a homo-condensate of lysine and one or more co-condensable compounds selected from the group consisting of:

i) compounds having at least one carboxyl group;

ii) carboxylic acid anhydrides;

iii) diketenes;

iv) amines;

v) lactams;

vi) alcohols;

vii) alkoxylated alcohols;

viii) alkoxylated amines; and xi) mixtures thereof.

4. A composition according to claim 3 wherein said co-polymer comprises lysine and aminocaproic acid.

5. A composition according to claim 1 wherein said polymeric material comprises a crosslinking unit selected from the group consisting of:

i) ethylene carbonate, propylene carbonate, urea, or mixtures thereof;

ii) monoethylenically unsaturated carboxylic acids and their esters, amides, and anhydrides; dibasic saturated carboxylic acids, polycarboxylic acids and the esters, amides, and anhydrides derived therefrom;

iii) reaction products of:

a) polyether diamines, alkylene diamines, polyalkylene polyamines, alkylene glycols or polyalkylene glycols, and mixtures thereof; and b) monoethylenically unsaturated carboxylic acids, esters, amides, or anhydrides wherein the reaction products comprise at least two units selected from the group consisting of ethylenically unsaturated double bonds, carboxamide, carboxyl, ester groups, and mixtures thereof;

iv) reaction products of dicarboxylic acid esters with ethyleneimine, wherein said products comprise at least two aziridino units;

v) di-epoxides, polyepoxides, $\alpha,\omega$-diisocyanates hexamethylene diisocyanate, inter alia, and polyisocyanates;

vi) and mixtures thereof.

6. A composition according to claim 5 wherein said crosslinking unit has the formula:

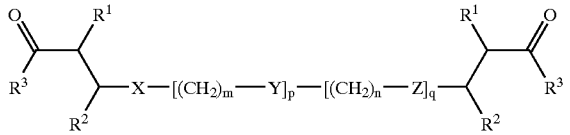

wherein X, and Z are each independently oxygen, —NH—, and mixtures thereof; Y is oxygen, —NH—, —$CH_2$—, and mixtures thereof; $R^1$ is hydrogen, methyl, and mixtures thereof; $R^2$ is hydrogen, —$CO_2R^4$, —$CO_2M$, —$CONH_2$, and mixtures thereof; $R^3$ is —$OR^4$, —$NH_2$, —OH, —OM, and mixtures thereof; $R^4$ is $C_1$–$C_{22}$ alkyl, M is hydrogen or a salt forming cation, and mixtures thereof; m and n are each independently from 0 to 4, and p and q are each independently form 0 to 45,000.

7. A composition according to claim 1 wherein said polymeric material is the co-polymer formed from the reaction of a $C_1$–$C_{22}$ mono-carboxylic acid and an amino acid selected from the group consisting of ornithine, lysine and mixtures thereof.

8. A composition according to claim 1 further comprising adjunct ingredients selected from the group consisting of electrolytes, stabilizers, low molecular weight water soluble solvents, chelating agents, cationic charge booster, dispersibility aids, soil release agents, nonionic fabric softening agents, concentration aid, perfume, preservatives, colorants, optical brighteners, opacifiers, fabric care agents, anti-shrinkage agents, anti-wrinkle agents, fabric crisping agents, spotting agents, germicides, fungicides, anti-corrosion agents, antifoam agents, and mixtures thereof.

9. A composition according to claim 1 further comprising a chelant having the formula:

$$(R^1)_2N-R-[\overset{R^2}{\overset{|}{N}}-R]_n-N(R^1)_2$$

wherein R is ethylene, 1,2-propylene, 1,3-propylene, and mixtures thereof; $R^1$ is hydrogen, $C_1$–$C_4$ alkyl, 2-hydroxypropyl, alkyleneoxy having the formula:

$$-(R^3O)-R^4$$

wherein each $R^3$ is independently ethylene, 1,2-propylene, 1,2-butylene, or mixtures thereof, $R^4$ is hydrogen, $C_1$–$C_4$ alkyl, or mixture thereof, and mixtures thereof; $R^2$ is $R^1$, $-RN(R^1)_2$, and mixtures thereof; n is from 0 to 3.

10. A composition according to claim 1 wherein said fabric softener active comprises a quaternary ammonium compound having the formula:

$$\left[(R)_{4-m}N^+-\left[(CH_2)_n-Q-R^1\right]_m\right]X^-,$$

an amine having the formula:

$$(R)_{3-m}N-\left[(CH_2)_n-Q-R^1\right]_m,$$

and mixtures thereof; wherein each R is independently $C_1$–$C_6$ alky, $C_1$–$C_6$ hydroxyalkyl, benzyl, and mixtures thereof; $R^1$ is $C_1$–$C_{22}$ alkyl, $C_3$–$C_{22}$ alkenyl, and mixtures thereof; Q is a carbonyl moiety having the formula:

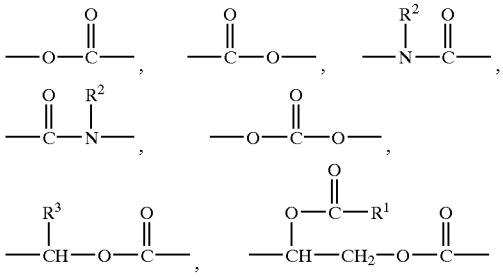

wherein $R^2$ is hydrogen, $C_1$–$C_4$ alkyl, $C_1$–$C_4$ hydroxyalkyl, and mixtures thereof, $R^3$ is hydrogen, $C_1$–$C_4$ alkyl, and mixtures thereof; X is a softener compatible anion; m is from 1 to 3; n is from 1 to 4.

11. A composition according to claim 10 wherein said fabric softening active comprises an acyl moiety which is derived from a source of triglyceride selected from the group consisting of tallow, hard tallow, lard, canola oil, partially hydrogenated canola oil, safflower oil, partially hydrogenated safflower oil, peanut oil, partially hydrogenated peanut oil, sunflower oil, partially hydrogenated sunflower oil, corn oil, ally hydrogenated corn oil, soybean oil, partially hydrogenated soybean oil, tall oil, partially hydrogenated tall oil, rice bran oil, partially hydrogenated rice bran oil, synthetic triglyceride feedstocks, and mixtures thereof.

12. A composition according to claim 1 further comprising a principal solvent wherein said principal solvent has a ClogP of from about 0.15 to about 1.

13. A composition according to claim 12 wherein said principal solvent is selected from the group consisting of mono alcohols, $C_6$ diols, $C_7$ diols, the isomers of octanediol derivatives of butanediol, the isomers of trimethylpentanediol, the isomers of ethylmethylpentanediol, the isomers of propylpentanediol, the isomers of dimethylhexanediol, the isomers of ethylhexanediol, the isomers of methylheptanediol, the isomers of octanediol, the isomers of nonanediol, alkyl glyceryl ethers, di(hydroxy alkyl) ethers, aryl glyceryl ethers the derivatives of alicyclic diols, derivatives of alkoxylated $C_3$–$C_7$ diols, aryl diols, and mixtures thereof.

14. A composition according to claim 13 comprising 2,2,4-trimetyl-1,3-pentandiol, 1,2-hexandiol, 2-ethyl-1,3-hexanediol, phenoxyethanol, butyl carbitol, and mixtures thereof.

15. A fabric enhancement composition comprising:

A) from about 0.1% to about 30% by weight, of a polymeric material selected from the group consisting of:

a) co-condensates of basic amino acids, said amino acids selected from the group consisting of lysine, ornithine, arginine, and typtophan;

(b) co-polymers produced from the reaction of one or more basic amino acids, said amino acids selected from the group consisting of lysine, ornithine, arginine, and trytophan with one or more co-condensable compounds;

c) co-condensates formed from the reaction of:

i) basic amino acids, said amino acids selected from the group consisting of lysine, ornithine, arginine, and tryptophan;

ii) co-condensable compounds;

iii) crosslinking agents; and d) mixtures thereof;

wherein said co-condensates from (a), co-polymers from (b), and co-condensates from (c), are alkoxylated with from an average of 0.1 to about 30 alkyleneoxy units;

B) from about 1% to about 60% by weight, of a fabric softening active.

16. A composition according to claim 1 wherein the composition is a laundry pre-soak composition.

* * * * *